US008574051B2

(12) United States Patent
Popovich et al.

(10) Patent No.: US 8,574,051 B2
(45) Date of Patent: Nov. 5, 2013

(54) TIME BASED CASINO WAGERING WITH OPTIONAL REINVESTMENT

(75) Inventors: Alexander Popovich, Henderson, NV (US); Thierry Brunet de Courssou, Missilac (FR); Cameron Anthony Filipour, Las Vegas, NV (US); Adam Singer, Las Vegas, NV (US)

(73) Assignee: IGT, Las Vegas, NV (US)

( * ) Notice: Subject to any disclaimer, the term of this patent is extended or adjusted under 35 U.S.C. 154(b) by 1219 days.

(21) Appl. No.: 12/352,277

(22) Filed: Jan. 12, 2009

(65) Prior Publication Data

US 2010/0009742 A1 Jan. 14, 2010

Related U.S. Application Data

(60) Provisional application No. 61/022,198, filed on Jan. 18, 2008.

(51) Int. Cl.
*A63F 1/00* (2006.01)
*G07F 17/32* (2006.01)

(52) U.S. Cl.
USPC ..... 463/13; 463/26; 463/20; 463/16; 463/17; 463/19

(58) Field of Classification Search
USPC ..... 463/13, 26
See application file for complete search history.

(56) References Cited

U.S. PATENT DOCUMENTS 4,593,904 A 6/1986 Graves
4,695,053 A 9/1987 Vasquez et al.
5,265,874 A 11/1993 Dickinson et al.
5,280,909 A 1/1994 Tracy
5,290,033 A 3/1994 Bittner et al.
5,342,049 A 8/1994 Wichinsky et al.
5,354,202 A 10/1994 Moncrief et al.
5,743,523 A 4/1998 Kelly et al.

(Continued)

FOREIGN PATENT DOCUMENTS

GB 2170937 A 8/1986
WO WO0141892 A2 6/2001

OTHER PUBLICATIONS

International Search Report of Mar. 23, 2009 in corresponding PCT application PCT/US09/31210.

(Continued)

*Primary Examiner* — Zandra Smith
*Assistant Examiner* — Tsz Chiu
(74) *Attorney, Agent, or Firm* — Neal, Gerber & Eisenberg LLP

(57) ABSTRACT

Time Based Wagering with Optional Reinvestment allows casino players to play their favorite casino games in a mixed time-based and credit-based fashion. The player purchases a contract for a window of time on the gaming machine at a set price that guarantees him or her the ability to play at a pace of his choosing over the entire duration of his contract. As the player accumulates winnings dining the execution of the time contract, the player may elect to protect his or her accrued winnings by cashing them out at the end of his contract or may elect to re-invest part or all of his accrued winnings for the opportunity to achieve even larger wins as the time contract progresses. The player may activate this optional feature by placing additional wagers via a dynamic wager selection menu.

67 Claims, 10 Drawing Sheets

(56) References Cited

U.S. PATENT DOCUMENTS

| | | | | |
|---|---|---|---|---|
| 5,816,913 | A | 10/1998 | Nakamura | |
| 5,823,873 | A * | 10/1998 | Moody | 463/13 |
| 5,890,963 | A | 4/1999 | Yen | |
| 5,910,046 | A | 6/1999 | Wada et al. | |
| 6,012,983 | A | 1/2000 | Walker et al. | |
| 6,048,269 | A | 4/2000 | Burns et al. | |
| 6,050,895 | A | 4/2000 | Luciano, Jr. et al. | |
| 6,077,163 | A | 6/2000 | Walker et al. | |
| 6,146,273 | A | 11/2000 | Olsen | |
| 6,171,186 | B1 | 1/2001 | Kurosawa et al. | |
| 6,179,713 | B1 | 1/2001 | James et al. | |
| 6,182,086 | B1 | 1/2001 | Lomet et al. | |
| 6,238,288 | B1 | 5/2001 | Walker et al. | |
| 6,244,957 | B1 | 6/2001 | Walker et al. | |
| 6,267,669 | B1 | 7/2001 | Luciano, Jr. et al. | |
| 6,283,474 | B1 | 9/2001 | de Keller | |
| 6,319,127 | B1 | 11/2001 | Walker et al. | |
| 6,409,597 | B1 | 6/2002 | Mizumoto | |
| 6,425,823 | B1 | 7/2002 | Byrne | |
| 6,428,413 | B1 | 8/2002 | Carlson | |
| 6,517,433 | B2 | 2/2003 | Loose et al. | |
| 6,522,312 | B2 | 2/2003 | Ohshima et al. | |
| 6,645,075 | B1 | 11/2003 | Gatto et al. | |
| 6,656,047 | B1 | 12/2003 | Tarantino | |
| 6,749,510 | B2 | 6/2004 | Giobbi | |
| 6,761,632 | B2 | 7/2004 | Bansemer et al. | |
| 6,761,636 | B2 | 7/2004 | Chung et al. | |
| 6,811,482 | B2 | 11/2004 | Letovsky | |
| 7,011,581 | B2 | 3/2006 | Tarantino | |
| 7,081,050 | B2 | 7/2006 | Tarantino | |
| 7,094,149 | B2 | 8/2006 | Walker | |
| 7,140,964 | B2 | 11/2006 | Walker | |
| 7,156,739 | B2 | 1/2007 | Walker | |
| 7,179,168 | B1 | 2/2007 | Walker | |
| 7,291,067 | B2 | 11/2007 | Tarantino | |
| 7,291,070 | B2 | 11/2007 | Gatto et al. | |
| 7,371,173 | B2 | 5/2008 | Gatto et al. | |
| 8,231,453 | B2 * | 7/2012 | Wolf et al. | 463/20 |
| 8,435,111 | B2 * | 5/2013 | Filipour et al. | 463/20 |
| 2002/0128065 | A1 | 9/2002 | Chung et al. | |
| 2002/0132660 | A1 | 9/2002 | Taylor | |
| 2002/0147040 | A1 | 10/2002 | Walker | |
| 2003/0171140 | A1 | 9/2003 | Gatto et al. | |
| 2003/0211881 | A1 | 11/2003 | Walker | |
| 2004/0102238 | A1 | 5/2004 | Taylor | |
| 2005/0148377 | A1 | 7/2005 | Goldberg et al. | |
| 2005/0192087 | A1 | 9/2005 | Friedman et al. | |
| 2006/0025207 | A1 | 2/2006 | Walker | |
| 2006/0281509 | A1 | 12/2006 | Arias-Vargas et al. | |
| 2007/0087818 | A1 | 4/2007 | Walker | |
| 2007/0105619 | A1 | 5/2007 | Kniesteadt et al. | |
| 2007/0142108 | A1 | 6/2007 | Linard et al. | |
| 2007/0191094 | A1 | 8/2007 | Walker et al. | |
| 2007/0298857 | A1 | 12/2007 | Schlottmann | |
| 2008/0015004 | A1 | 1/2008 | Gatto | |
| 2008/0026826 | A1 * | 1/2008 | Groswirt | 463/25 |

OTHER PUBLICATIONS

Written Opinion of the International Searching Authority of Mar. 23, 2009 in corresponding PCT application PCT/US09/31210.

* cited by examiner

TIME BASED CASINO WAGERING WITH OPTIONAL REINVESTMENT

BACKGROUND OF THE INVENTION

Embodiments of the present inventions relate generally to the field of regulated pay computer-controlled games, either games of skills or games of chance.

SUMMARY OF THE INVENTION

Embodiments of the present invention; namely, methods and systems for time based casino wagering featuring a reinvestment option, allow players to purchase a time based casino wagering contract in which: 1) the player is able to make repeated wagers for the duration of his or her gaming contract and 2) the player, having earned winnings, is given the opportunity to risk some or all of those winnings to potentially achieve even greater returns on subsequent wagers within the contract's duration. Such methods represent an alternative to Cyberview Technology's Cashless Time Gaining system (U.S. Pat. No. 6,645,075, which patent is incorporated herein by reference in its entirety) in which players purchase a time based contract and then may wager at any pace desired during that contract but may not use winnings earned within the contract's duration to purchase the opportunity to achieve greater winnings as the contract progresses. Methods and systems for time based casino wagering featuring a reinvestment option (referred to hereafter as "Time Gaming with Reinvestment"), according to embodiments of the present invention, are designed to appeal to a player looking for a more volatile time based gaming experience in which larger wins are possible. Time Gaming with Reinvestment will also appeal to game operators as it encourages players to "churn" or reinvest their winnings, a wagering behavior that maximizes casino profits.

According to an embodiment thereof, the present invention is a method of providing a game session on a gaming machine, comprising: activating the game session on the gaming machine with a credit of playing time provided by a player of the gaming machine, the game session lasting an amount of time determined by the provided credit of playing time; maintaining session credit meters during the game session; placing a wager during the game session; enabling the player to place an extra bet to selectively increase a potential outcome of the wager when the session credit meters indicate an amount of credits that may be larger than a predetermined amount and disabling the player's ability to selectively increase the potential outcome otherwise, and generating a random outcome for the wager and updating the session credit meters according to the wager placed, any extra bet placed, a selected paytable and the generated random outcome.

The increased potential outcome enabling step may be carried out by increasing the amount of the wager by an amount no greater than the current amount indicated by the session credit meters. The increased potential outcome enabling step may be carried out by applying a selected outcome multiplier to any base winnings indicated by the generated random outcome. The session credit meters maintaining step may include initializing the session credit meters to zero at the beginning of the game session. The session credit meters maintaining step may include initializing the session credit meters to a non-zero value at the beginning of the game session. The placing step may be carried out even when the session credit meters indicate a zero value. The gaining machine may be a reel-type slot machine and the generating step may be carried out with the random outcome being a combination of symbols. The method may further include a step of offering a plurality of game session contracts to the player, each of the offered game session contracts costing a different number of credits and lasting a different amount of time. The gaming machine may be configured as a slot machine. The gaming machine may be configured as a reel type slot machine. The enabling step may include a step of providing or activating a plurality of extra bet buttons, each of the extra bet buttons being configured to enable the player to place an extra bet that is at least as great as the predetermined amount. The session credit meters updating step may include increasing the session credit meters. The maintaining step may include a step of debiting the session credit meters by an amount of the extra bet when the generated random outcome is a losing outcome. The method may further include a step of monitoring the game during the game session to detect when one of a plurality of wager triggering interactions occurs within the game and carrying out the wager placing step upon occurrence of one of the wager triggering interactions. The method may also include a step of receiving an instruction from the player and carrying out the wager placing step upon receipt of the player instruction.

According to another embodiment thereof, the present invention is a gaming machine, comprising at least one processor; at least one data storage device coupled to the at least one processor; a plurality of processes spawned by said at least one processor, the processes including processing logic for, in combination with the at least one data storage device, activating a game session on the gaming machine with a credit of playing time provided by a player of the gaming machine, the game session lasting an amount of time determined by the provided credit of playing time; maintaining session credit meters dining the game session; enabling a wager to be placed during the game session; enabling the player to place an extra bet to selectively increase a potential outcome of the wager when the session credit meters indicate an amount of credits that is larger than a predetermined amount and disabling the player's ability to selectively increase the potential outcome otherwise, and generating a random outcome for the wager and updating the session credit meters according to the wager placed, any extra bet placed, a selected paytable and the generated random outcome.

According to still another embodiment thereof, the present invention is a method of providing a game session on a gaming machine, comprising activating the game session on the gaming machine with a credit of playing time provided by a player of the gaming machine, the game session enabling the player to play a game on the gaming machine for an amount of time determined by the provided credit of playing time; maintaining session credit meters during the game session; monitoring the game during the game session to detect when a wager triggering interactions occur within the game; placing a wager when a wager triggering interaction is detected, an amount of the placed wager being a function of elapsed time; enabling the player to place an extra bet to selectively increase a potential outcome of the wager when the session credit meters indicate an amount of credits that is larger than a predetermined amount and disabling the player's ability to place the extra bet otherwise, and generating a random outcome for the wager and updating the session credit meters according to the wager placed, any extra bet placed, a selected paytable and the generated random outcome.

The wager placing step may be carried out with the elapsed time being determined as a function of an elapsed time since the game session was activated. The wager placing step may be carried out with the elapsed time being determined as a function of an elapsed time since a previous wager was placed during the game session. The extra bet in the enabling step may be configured to increase an amount of the wager by an amount no greater than the current amount indicated by the session credit meters. The extra bet in the enabling step may be configured to increase the potential outcome of the wager by applying a selected outcome multiplier to any base winnings indicated by the generated random outcome. The session credit meters maintaining step may include initializing the session credit meters to zero at the beginning of the game session. The session credit meters maintaining step may include initializing the session credit meters to a non-zero value at a beginning of the game session. The placing step may be carried out even when the session credit meters indicate a zero value. The gaming machine may be a reel-type slot machine and the generating step may be carried out with the random outcome being a combination of symbols. The gaming machine may be configured as a console-type gaming machine. The method may further include a step of offering a plurality of game session contracts to the player, each of the offered game session contracts costing a different number of credits and lasting a different amount of time. The method may be carried out with the gaming machine configured as a slot machine. The method may be carried out with the gaming machine configured as a reel type slot machine. The enabling step may include a step of providing or activating a plurality of extra bet buttons, each of the extra bet buttons being configured to enable the player to place an extra bet that is at least as great as the predetermined amount. The monitoring step may be carried out with the wager triggering interactions including selected in-game events. The monitoring step may be carried out with the wager triggering interactions being selected from among a plurality of interactions between the player and the game during the gaining session, and the wager placing step may be carried out only when one of the selected interactions occurs during the game session, and occurrence of other ones of the plurality of interactions do not result in the wager being placed. The maintaining step may include a step of debiting the session credit meters by the amount of the extra bet when the generated random outcome is a losing outcome.

Another embodiment of the present invention is a gaming machine, comprising: at least one processor; at least one data storage device coupled to the at least one processor; a plurality of processes spawned by said at least one processor, the processes including processing logic for, in combination with the at least one data storage device: activating the game session on the gaming machine with a credit of playing time provided by a player of the gaming machine, the game session enabling the player to play a game on the gaming machine for an amount of time determined by the provided credit of playing time; maintaining session credit meters during the game session; monitoring the game during the game session to detect when wager triggering interactions occur within the game; placing a wager when a wager triggering interaction is detected, an amount of the placed wager being a function of elapsed time; enabling the player to place an extra bet to selectively increase a potential outcome of the wager when the session credit meters indicate an amount of credits that is larger than a predetermined amount and disabling the player's ability to place the extra bet otherwise, and generating a random outcome for the wager and updating the session credit meters according to the wager placed, any extra bet placed, a selected paytable and the generated random outcome.

Still another embodiment of the present invention is a method of providing a game session on a gaming machine, comprising accepting an amount of money from a player of the gaming machine and setting a length of the game session according to the amount of money accepted from the player; maintaining session credit meters during the game session; enabling the player to set a pace at which wagers are placed during the game session and setting an amount of each wager according to the pace set by the player; selectively providing the player with opportunities to place extra bets to increase potential outcomes of the placed wagers when the session credit meters indicate a sufficient number of credits, and generating random outcomes for the wagers and updating the session credit meters according to the wagers placed, any extra bets placed, at least one selected paytable and the generated random outcomes.

The session credit meters maintaining step may include initializing the session credit meters to zero at the beginning of the game session. The session credit meters maintaining step may include initializing the session credit meters to a non-zero value at the beginning of the game session. The enabling and setting steps are carried out even when the session credit meters indicate a zero value. The gaming machine may be a reel-type slot machine and the generating step may be carried out with the random outcome being (or including) a combination of symbols. The gaming machine may be configured as a console-type gaming machine. The method may further include a step of offering a plurality of game session contracts to the player, each of the offered game session contracts costing a different number of credits and lasting a different amount of time. The gaming machine may be configured as a slot machine. The gaming machine may be configured as a reel type slot machine. The session credit meters updating step may include increasing the session credit meters. The maintaining step may include a step of debiting the session credit meters by an amount of the extra bet when the generated random outcome is a losing outcome. The method may further include a step of receiving an instruction from the player and carrying out the wager placing step upon receipt of the player instruction.

According to yet another embodiment, the present invention is a gaming machine, comprising at least one processor; at least one data storage device coupled to the at least one processor; a plurality of processes spawned by said at least one processor, the processes including processing logic for, in combination with the at least one data storage device: accepting an amount of money from a player of the gaining machine and setting a length of the game session according to the amount of money accepted from the player; maintaining session credit meters dining the game session; enabling the player to set a pace at which wagers are placed during the game session and setting an amount of each wager according to the pace set by the player; selectively providing the player with opportunities to place extra bets to increase potential outcomes of the placed wagers when the session credit meters indicate a sufficient number of credits, and generating random outcomes for the wagers and updating the session credit meters according to the wagers placed, any extra bets placed, at least one selected paytable and the generated random outcomes.

Yet another embodiment of the present invention is a method of providing a game session on a gaming machine, comprising activating the game session on the gaming machine with a credit of playing time provided by a player of the gaming machine, the game session lasting an amount of time determined by the provided credit of playing time; maintaining session credit meters dining the game session; placing a wager dining the game session; determining an amount of the wager placed during the game session as a function of elapsed time; enabling the player to place an extra bet to selectively increase a potential outcome of the wager when the session credit meters indicate an amount of credits that is larger than a predetermined amount and disabling the player's ability to selectively increase the potential outcome otherwise, and generating a random outcome for the wager and updating the session credit meters according to the wager placed, any extra bet placed, a selected paytable and the generated random outcome.

The determining step may be carried out with the elapsed time being determined as a function of an elapsed time since the game session was activated. The determining step may be carried out with the elapsed time being determined as a function of the elapsed time since the triggering of a (or the) previous wager placed during the game session. The increased potential outcome enabling step may be carried out by increasing an amount of the wager by an amount no greater than the current amount indicated by the session credit meters. The increased potential outcome enabling step may be carried out by applying a selected outcome multiplier to any base winnings indicated by the generated random outcome. The session credit meters maintaining step may include initializing the session credit meters to zero at the beginning of the game session. The session credit meters maintaining step may include initializing the session credit meters to a non-zero value at the beginning of the game session. The placing step may be carried out even when the session credit meters indicate a zero value. The gaming machine may be a reel-type slot machine and the generating step may be carried out with the random outcome being (or including) a combination of symbols. The gaming machine may be configured as a console-type gaming machine. The method may further include a step of offering a plurality of game session contracts to the player, each of the offered game session contracts costing a different number of credits and lasting a different amount of time. The gaming machine may be configured as a slot machine. The gaming machine may be configured as a reel type slot machine. The enabling step may include a step of providing or activating a plurality of extra bet buttons, each of the extra bet buttons being configured to enable the player to selectively increase a potential outcome of wagers placed on the gaming machine for a predetermined period of time. Each of the plurality of extra bet buttons may be configured, when selected by the player, to cost the player a predetermined amount of credits and to increase the potential outcome of any wagers placed during the predetermined period of time by a predetermined amount and the method further may include a step of dynamically calculating the predetermined amount of credits, period of time and amount based on current game conditions. The session credit meters updating step may include increasing the session credit meters. The maintaining step may include a step of debiting the session credit meters by the amount of the extra bet when the generated random outcome is a losing outcome. The method may also include a step of monitoring the game during the game session to detect when one of a plurality of wager triggering interactions occurs within the game and carrying out the wager placing step upon occurrence of one of the wager triggering interactions. The method may further include a step of receiving an instruction from the player and carrying out the wager placing step upon receipt of the player instruction.

The present invention, according to a still further embodiment thereof, may be or include a gaming machine, comprising at least one processor; at least one data storage device coupled to the at least one processor; a plurality of processes spawned by said at least one processor, the processes including processing logic for, in combination with the at least one data storage device: activating the game session on the gaming machine with a credit of playing time provided by a player of the gaming machine, the game session lasting an amount of time determined by the provided credit of playing time; maintaining session credit meters during the game session; placing a wager during the game session; determining an amount of the wager placed during the game session as a function of elapsed time; enabling the player to place an extra bet to selectively increase a potential outcome of the wager when the session credit meters indicate an amount of credits that is larger than a predetermined amount and disabling the player's ability to selectively increase the potential outcome otherwise, and generating a random outcome for the wager and updating the session credit meters according to the wager placed, any extra bet placed, a selected paytable and the generated random outcome.

DETAILED DESCRIPTION

In the following detailed description of exemplary embodiments of the invention, reference is made to the accompanying drawings, which form a part hereof, and in which is shown by way of illustration specific exemplary embodiments in which the invention may be practiced. These embodiments are described in sufficient detail to enable those skilled in the all to practice the invention, and it is to be understood that other embodiments may be utilized and that logical, mechanical, electrical and other changes may be made without departing from the spirit or scope of the present invention. The following detailed description is, therefore, not to be taken in a limiting sense, and the scope of the present invention is defined only by the appended claims.

Figure 1:
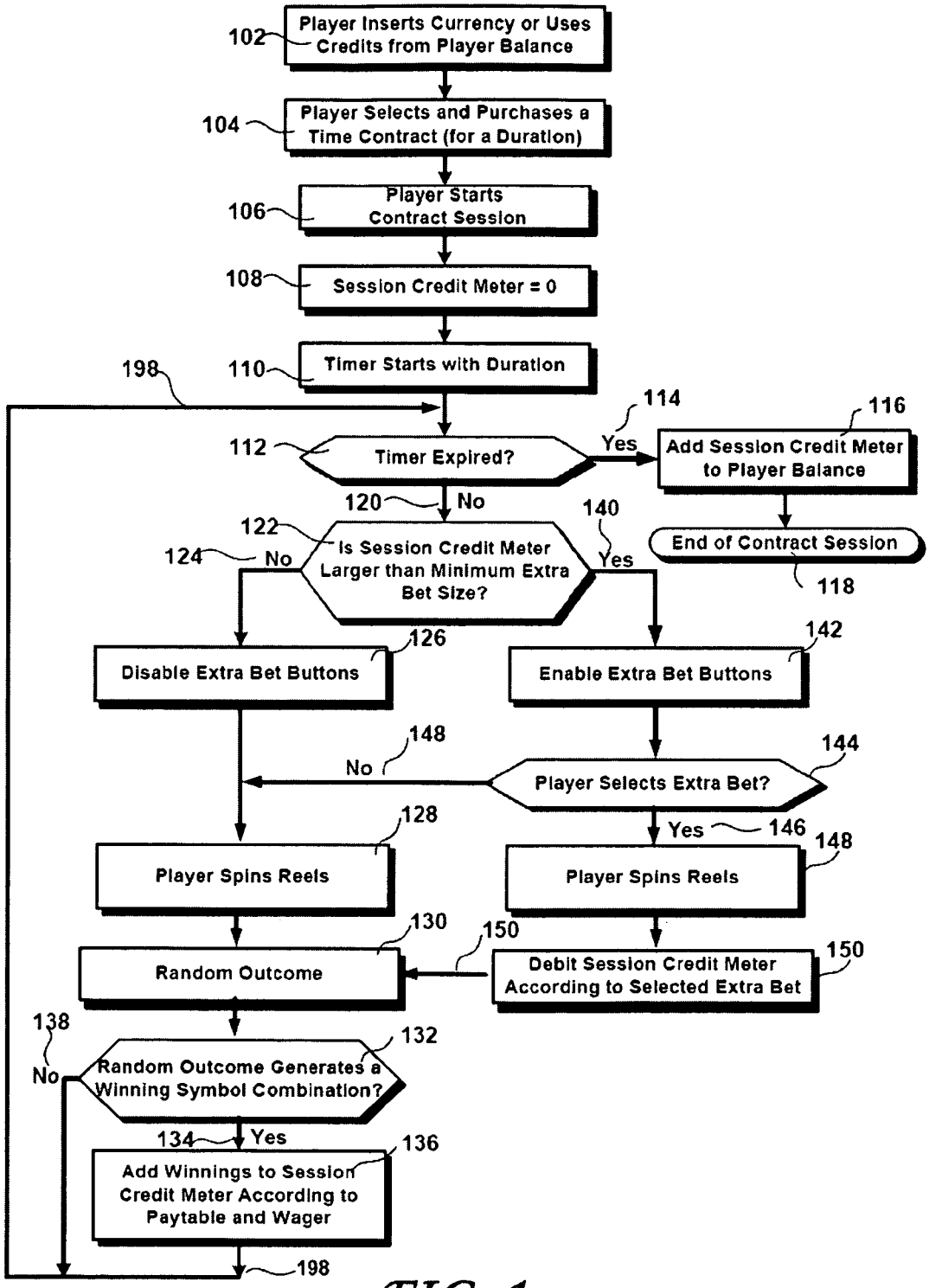
FIG. 1 shows an exemplary flow of game play on a regulated gaming machine configured with time based casino wagering featuring a static reinvestment option, according to an embodiment of the present invention.

FIG. 1 shows an exemplary flow of game play on a regulated gaining machine configured with time based casino wagering featuring a static reinvestment option, according to an embodiment of the present invention. According to embodiments of the present inventions, there are two distinct varieties of Time Casino Games with Reinvestment. Games featuring Static Reinvestment allow players to invest winnings earned within their time based gaming session to increase the size of their next single bet. Games featuring Dynamic Reinvestment allow players to invest winnings earned within their time based gaming session to increase the size of all wagers they make over a predetermined period of time.

Players fund a Time Game with Static Reinvestment by, for example, inserting currency as shown at 102 or by allocating currency from a credit balance already available on the gaming machine. Players wishing to play a Time Game with Static Reinvestment may then select a contract type as shown at 104 and purchase it at an agreed price for a set duration. For example, the player may purchase a 5 minute contract to play a Time Based Slot Machine with Static Reinvestment for $5. Both the duration of the contract and its cost advantageously may be predetermined, packaged together, and presented to the player as a menu offering of contract types. According to embodiments of the inventions described herein, the menu of offerings provided to gaming operators may be customizable, to enable the operators of gaming establishments to select and/or set the contract duration and price combinations that they believe will best meet the demands of their customers.

Because Time Slot Games with Static Reinvestment are time-based, players must press a start button to start the contract session, as shown at 106. At 108, the session credit meter is initialized to zero and the timer begins with the duration associated with the selected contract, as shown at 110. It is to be noted that the session credit meter may be initialized to an amount other than zero. The timer is incremented (or decremented) by a clock set to a small periodicity, every millisecond for example, and may be continually monitored to determined if the timer has expired, as shown at 112. If the timer has expired (YES branch 114), then the current value of the session credit meter is added to the player balance as shown at 116 and the contract session is terminated at step 118.

As long as the timer has not expired (NO branch 120), the player may make selections and press the bet button (or pull the handle or other player actuated bet mechanism) to place a wager and to trigger the spinning of the wheels and potentially win credits if and when a winning combination of symbols is ultimately revealed. Prior to triggering the spinning of the wheels, the session credit meter may be evaluated at 122 to verify whether one or a plurality of reinvestment options should be offered to the player. A range of reinvestment options may be offered at some predetermined price via activated "Extra Bet" buttons that the player may select if the session credit meter shows that sufficient funds have accumulated during the contract session, as shown by the YES branch 140 of 122. That is, a reinvestment option may be offered to the player if the session credit meters indicate an amount that is at least as great as the or one of a plurality of predetermined amounts, indicated by one or more activated "Extra Bet" buttons. If insufficient funds are available in the session credit meters (NO branch 124) then no reinvestment option is offered and any previously offered extra bet buttons are cleared, inactivated or otherwise disabled, as shown at 126. The player then has only the option to trigger the spinning of the reels as shown at 128 by pressing the bet button (at no additional cost to the player as the wager associated with the spin is already included in the time contract). According to an embodiment of the present inventions, after the player has spun the reels as shown at 128, a random outcome may be generated, as shown at 130. At 132, it is determined whether the outcome of the spinning of the reels has resulted in a winning combination of symbols across one or more of the available paylines. If yes 134, the player's winnings are determined based upon the size of the wager placed and the game's paytable, as shown at 136. If no winning combination of symbols has occurred as shown at 138, then the game flow reverts back to step 112, as is shown at 198. As shown at 136, any player winnings may then be added to the player's session credit meters and the game flow reverts back to step 112, as shown at 198.

When, as shown at the YES branch 140 of step 122, the session credit meter is greater than the minimums extra bet size, a range of reinvestment options may be offered to the player, according to embodiments of the present invention. The range of reinvestment options may be offered at some predetermined price (cost to the player) via "Extra Bet" buttons that are made available to the player, provided that the session credit meter indicate that sufficient number of credits have been accumulated during the contract session. If sufficient funds are indeed available in the session credit meters, then reinvestment options may be offered via the activation of extra bet buttons by the player, as shown at 142. The player may select one or more of the extra bet buttons. For example, the player may elect to spend twenty credits to wager four credits on each of five paylines as an alternative to the base bet of one credit per payline. The "extra bet" in this instance would, therefore, consist of three extra credits on each of the five paylines, and the player would have activated the appropriate "Extra Bet" buttons to cause the base bet level of one credit on each payline to be increased to 4 credits on each of the 5 paylines. In the Static Reinvestment model, extra bets apply to the player's next bet only.

If, at 144, the player does not elect to make the extra bet, the method proceeds to step 128, as shown at 148. If the player does wish to make the extra bet, as is shown at 146, the player presses the extra bet button and triggers a spin of the reels, as shown at 148.

Subsequent to triggering the spinning of the reels at 148, the player's session credit meters are debited at 150 according to the extra bet amount selected by the player. At this point, the game accepts the player's increased wager size and rejoins the standard game flow at the point in which a random outcome is generated, shown at 150. Wins occurring in this sequence—i.e. after the extra bet button has been selected—will be larger to reflect larger bet multipliers. For example, a hypothetical player who chooses not to select an available extra credit bet might achieve a symbol combination that wins him 10 credits. Had that same player elected to purchase the 4× extra bet, the very same symbol combination that would otherwise have won 10 credits would now win 40 credits.

As shown at 112, as long as the player has time remaining on his or her contract (i.e. the timer has not expired), then the player will retain the ability to spin the reels, irrespective of whether the player has sufficient credit to select extra bets. Indeed, even without any credits in the session credit meter, the player retains the ability spin the reels (and thus place wagers); only his or her ability to select extra bets will be affected by a zero session credit meter balance.

Figure 2:
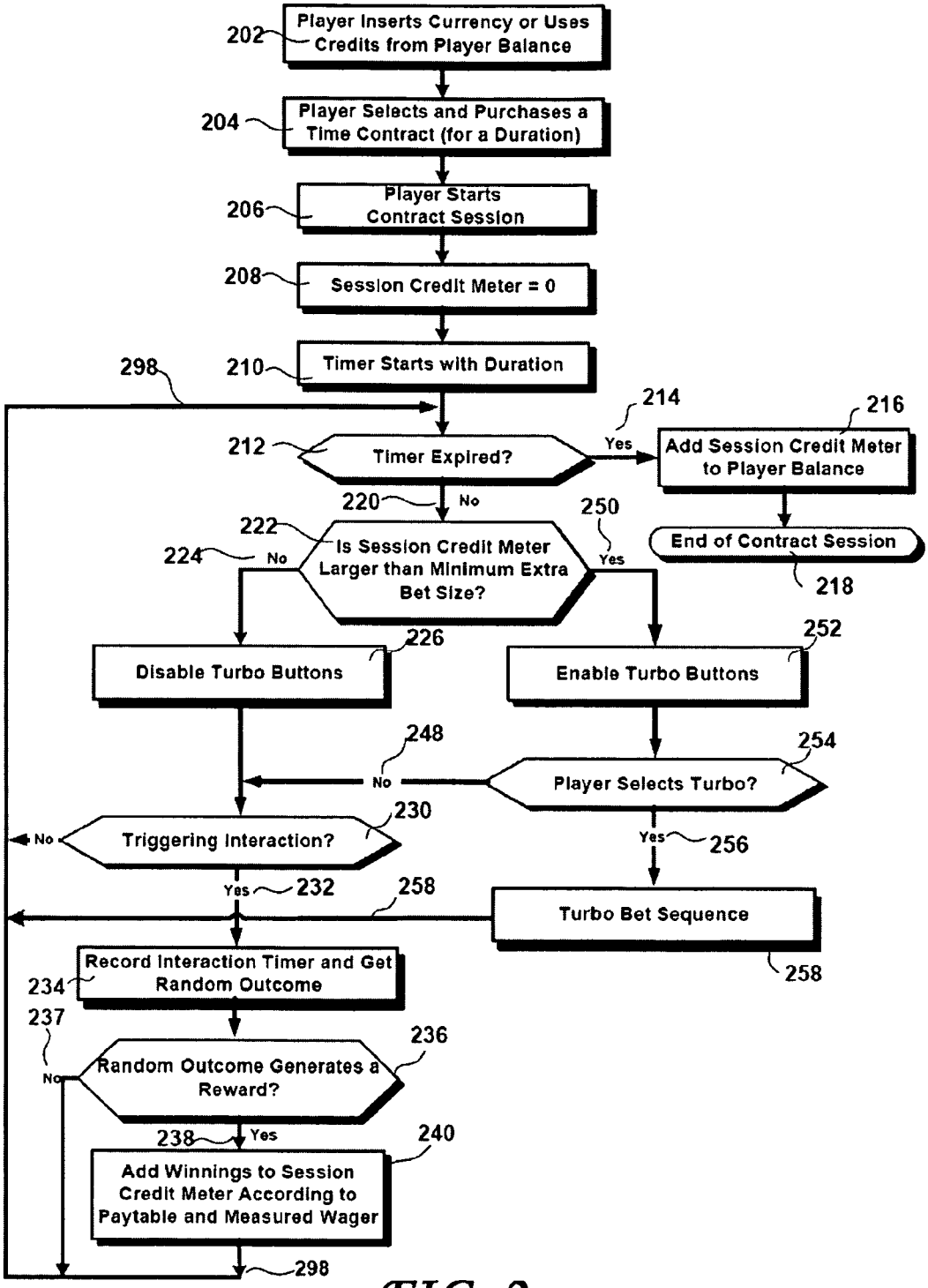
FIG. 2 shows an exemplary game flow for game play on a regulated gaming machine configured with time based casino wagering featuring a dynamic reinvestment option, according to embodiments of the present invention.

FIG. 2 shows an exemplary game flow for game play on a regulated gaming machine configured with time based casino wagering featuring a dynamic reinvestment option (as opposed to the static reinvestment option described above relative to FIG. 1), according to embodiments of the present invention. While static reinvestment allows the player to increase the size of his next wager, Dynamic Reinvestment allows the player to increase the size of all of his or her wagers over a predetermined period of time.

As is shown at 202, a player may fund a Time Game with Dynamic Reinvestment by, for example, inserting currency or by allocating currency from the player credit balance already available on the gaming machine. The player may then select a contract type as shown at 204 and purchase the selected contract, as shown at 204. A variety of contracts may be offered to the player for purchase, each offering a predetermined duration of game play in exchange for a predetermined amount of money. For example, the player may purchase a five minute contract to play a Time Based Pinball with Dynamic Reinvestment for $5. Both the duration of the contract and its cost may be predetermined, packaged together, and presented to the player as a menu offering of contract types. Options may be presented to the player to design their own contract, according to a predetermined formula. For example, the player may be given the ability to select a duration for the contract, whereupon the predetermined formula would be applied to the player-selected contract duration to provide the player with the cost of such contract. Alternatively, the player could decide how much money he or she wishes to spend (which may be subject to predetermined lower and upper limits), and the predetermined formula would then provide the player with the corresponding contract duration. Other embodiments are possible, as those of skill in this art may appreciate. According to embodiments of the inventions described herein, the menu of offerings provided to gaming operators may be customizable, to enable the operators of gaming establishments to select and/or set the contract duration and price combinations that they believe will best meet the demands of their customers.

Because Casino Games with Dynamic Reinvestment are time-based, players must press a start button 206 to start the contract session. The session credit meter is then set to zero as shown at 208 (as the player has not yet won anything) and the timer begins as shown at 210, with the duration of game play being determined by the specific contract purchased at 204. The timer is incremented (or decremented) by a clock set to a small periodicity, every second or millisecond for example, and is continually monitored, as shown at 212. If the timer has expired, as shown at the YES branch 214, the value (if any) of the session credit meter is added to the player balance as shown at 216 and the contract session is terminated, as shown at step 218. According to further embodiments, the player may be given an opportunity to continue the current contract session by inputting further funds into the gaming machine before a timer has elapsed.

As shown by the NO branch 220, as long as the timer has not expired, the player may make selections and press the interaction button(s) (or the pin button(s)) to trigger the throw of the ball (recall that the example developed herein is that of a pinball console-type game adapted for time based gaming with reinvestment, according to embodiments of the present invention). When the player's ball hits a bumper or other predetermined structure or mechanism within the pinball playfield, the player may win credits, depending upon a randomly drawn outcome. In most pinball games, the player's sole mode of interaction with the game is by pressing the flipper buttons. Indeed, the principal mode of player interaction in most pinball games consists of pressing the flipper buttons to try to bounce the ball tip against the bumpers, cause the ball to become trapped by some mechanism and to cause the ball to trigger various other detectors. The act of hitting a selected bumper of other selected structure or mechanism is, hereafter, called a "triggering interaction". The ball may experience other non-triggering interactions, which do not trigger a wager. Indeed, in any regulated game according to embodiments of the present invention, selected interactions may be classified as triggering interactions that lead to a wager being placed, while other interactions may be classified as non-triggering interactions that do not result in a wager being placed. For example, some of the pinball bumpers, traps and other features may be configured only for fun, to promote the player's enjoyment of the game and to enhance the flow of the game. That is, not every player interaction need result in a wager being placed, as some player interactions and/or onscreen events involving the game's graphic assets are just for fun or are configured solely to advance the narrative of the game.

Prior to pressing of an interaction button or prior to a triggering interaction, the session credit meter may be evaluated at 222 to determine whether one or a plurality of reinvestment options should be offered to the player. A range of reinvestment options may be offered at some predetermined price via activated "Turbo" buttons that the player may select if the session credit meters show that sufficient funds have accumulated during the contract session. Unlike the Static "Extra Bet" buttons described in FIG. 1, which allow the player to reinvest winnings to increase the size of their next bet only, the Dynamic "Turbo" buttons featured in FIG. 2 allow the player to reinvest winning to increase the size of all of the bets they make over a predetermined period of time.

Figure 6:
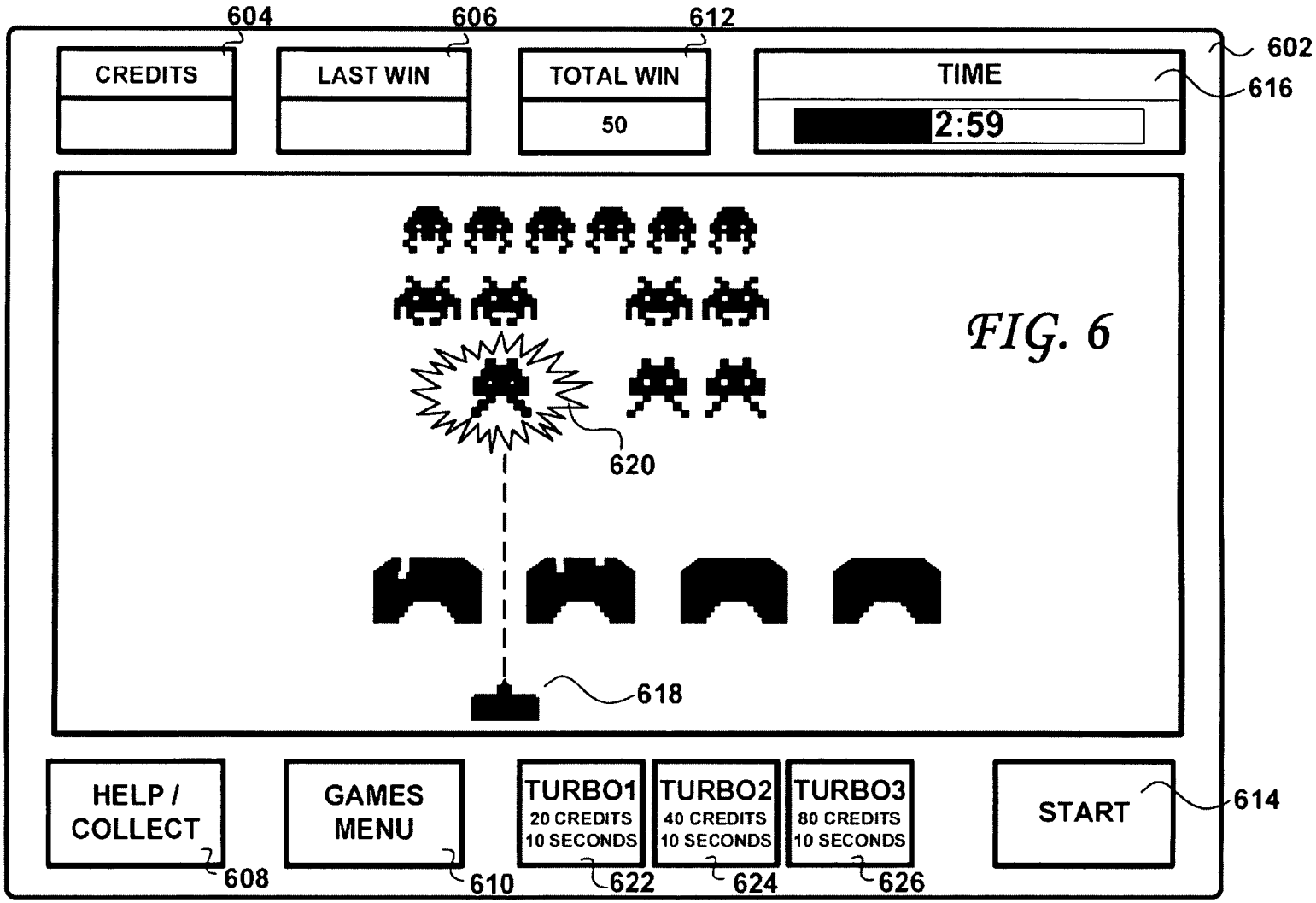
FIG. 6 shows an exemplary user interface that may be used on a Casino Video Game with Dynamic Reinvestment, according to embodiments of the present invention.

If insufficient funds are available in the session credit meters as shown by the NO branch at 224, then no reinvestment options are offered and any previously offered "Turbo" buttons are disabled, as shown at 226. If no triggering interaction has occurred (NO Branch 230); that is, the ball has not hit one of the selected bumpers, traps, game features or other selected predetermined detector, then the game flow reverts back to step 212, as shown at 298. It is to be noted that, as shown in FIG. 6, the flow of FIG. 2 may be readily adapted to other arcade-style games such as, for example, a shoot'em up game such as Star Fighter or other first person shooters, for example. In such a game, the player's interaction options may be limited to piloting his or her starship and pressing the fire button, although embodiments of the present inventions need not be so limited. In such a game, the available interactions may include moving the displayed starship around to avoid destruction, aiming at a target and pressing the fire button to send projectiles towards the target. A triggering interaction (that is, an interaction that triggers a wager) may then be defined as successfully avoiding obstacles and/or successfully hitting and/or destroying a designated target. For example, with reference to FIG. 2, if no triggering interaction has occurred as shown by the NO branch of 230 (that is, the projectile has not hit and/or destroyed its intended target), then the game flow reverts back to step 212 via 298). If, however, a triggering interaction has indeed occurred 232 (e.g., the pinball ball has hit a selected bumper or the starship projectile has hit and/or destroyed its intended target), the value of the interaction timer at the time of the triggering interaction is recorded and a random outcome is generated as shown at 234. Note that the player is afforded the opportunity to win credits by virtue of the triggering interaction at no additional cost to the player, as the wager associated with the triggering interaction is already included in the time contract that was previously purchased by the player. At 236, it is determined whether the random outcome generated a reward. If Yes, as indicated at 238, the winnings determined according to the paytable and measure wager and added to the session credit meters, as shown at 240, whereupon the method reverts to step 212 via 298 As shown by the NO branch 237, if no winning outcome is generated, the method reverts back to step 212 via 298.

The amount of the wager placed by the player by interacting with selected assets within the game environment may be measured according to the time gaming method described herein. That is, the amount of the wager may be a function of the time measured between the immediately previous triggering interaction and the current triggering interaction. This may be carried out by, for example, recording the value of the interaction timer as shown at 234 at the instant of the triggering interaction (i.e., when the ball hit a bumper or when the projectile destroyed a target), and calculating the time elapsed since the previous triggering interaction (the value of timer at each such triggering interaction being recorded), when the value of the interaction timer was last recorded. It is to be noted that the value of the interaction timer need not be recorded at the exact instant or moment of a triggering interaction, such as when a ball hits a selected bumper or when a projectile hits and/or destroys a selected target. Indeed, the value of the interaction time may be recorded at any other moment that is directly related to a player triggering interaction such as, for example, the start of a triggering interaction or the consequence of a triggering interaction, (such as when the selected bumper bounces the ball back, when a selected trap releases the ball or when a selected target explodes into pieces, to name but a few of the virtually limitless possibilities).

As shown at step 222, prior to the player carrying out or otherwise being instrumental in causing a triggering interaction, the session credit meter is evaluated to verify whether one or more reinvestment options should be offered to the player. If the session credit meters show that sufficient funds are available, a range of reinvestment options may be offered at predetermined prices (costs to the player) via player selectable activated "Turbo" buttons. If sufficient funds are available, as indicated by the session credit meters (YES branch 250 of step 222) then reinvestment options may be offered via the activation of "Turbo" buttons as shown at 252. The player then has the opportunity to avail him or herself of the extra bets and may choose to depress or otherwise actuate one or more of the "Turbo" buttons 254, launching at 256 the Turbo Bet Sequence 258, which is fully detailed in FIG. 3. The method then reverts back to step 212, as shown at 258. As long as the player has time remaining on his or her contract (i.e., the timer has not expired as shown by the NO branch 220), whether or not the player has sufficient credit to select extra bets 222, 224, 250, lie or she will retain the ability interact with the game and make triggering interactions, without requiring any further funds from the session credit meters, at a measured wager in accordance with the time gaming principle described herein, with any reward being a function of the measured wager. This means that even a player with a session credit meter balance of zero does not lose his or her ability to have wagers placed on triggering interactions at the measured wager in accordance with the time gaming principle described herein until the timer expires—that is, until the purchased time contract is over.

It should be noted that while the term "triggering interaction" has been used to describe a wager generating event (i.e. collision) occurring within a console style video game (in this case electronic pinball), "triggering interactions" may also occur when a player spins the reels of a video slot machine or elects to have a new hand or card dealt to him in a video poker game. As a result, Casino Games Featuring Dynamic Reinvestment may encompass a variety of game styles that are not limited to console style games. For example, a possible user interface on a Video Slot Machine featuring Dynamic Reinvestment is featured in FIG. 7.

Figure 3:
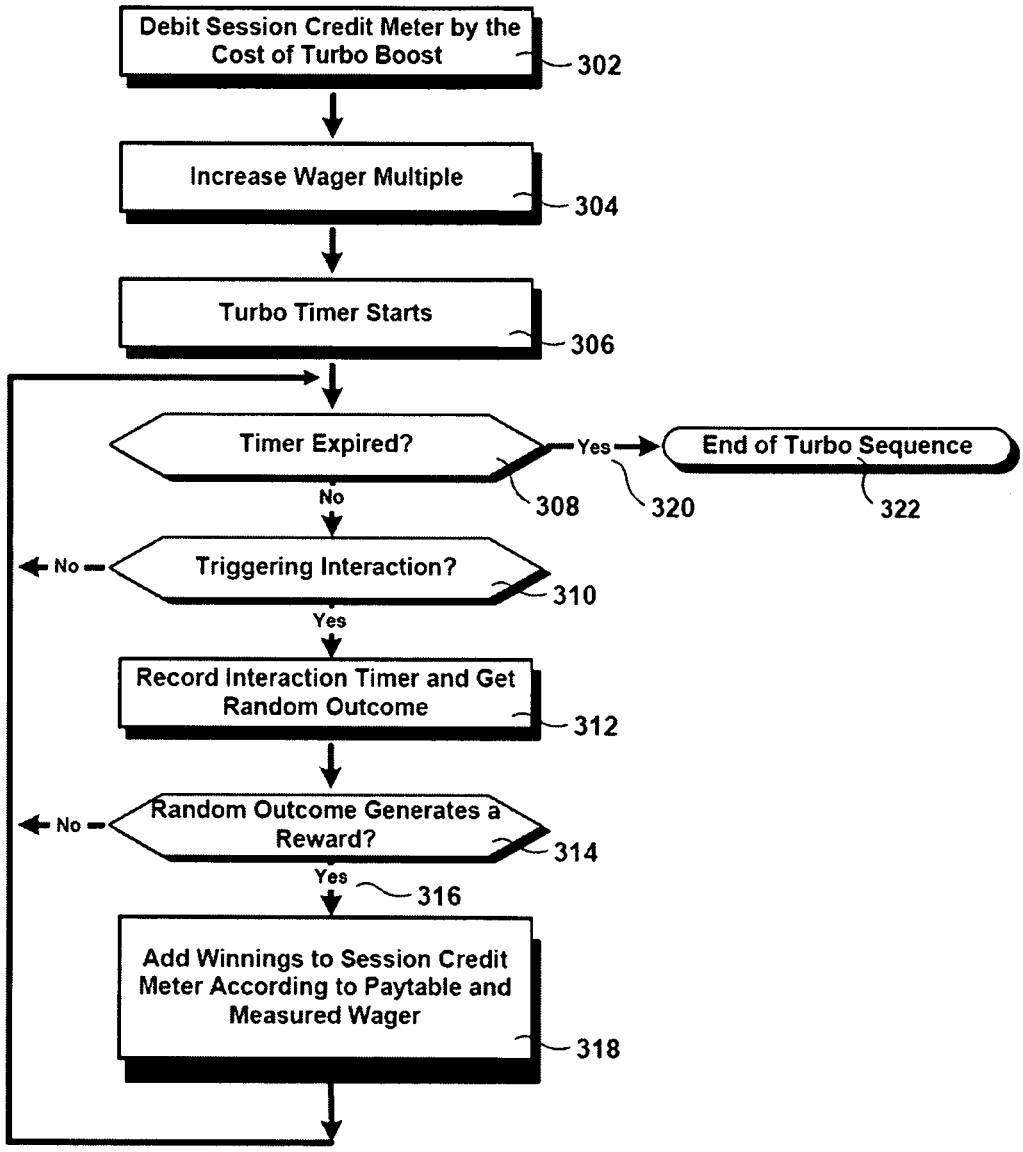
FIG. 3 shows an exemplary flow for the Turbo Bet Sequence occurring within a game featuring Dynamic Reinvestment, according to embodiments of the present invention.

FIG. 3 shows an exemplary flow for the Turbo Bet Sequence 258 of FIG. 2 occurring within a game featuring Dynamic Reinvestment, according to embodiments of the present invention. The Turbo Bet Sequence is triggered when a player (who has earned a sufficient number of credits within his Time Gaming Session to activate the Turbo Bet Feature) selects at least one of the Turbo Bet Options provided to him within the game (as suggested at 256 of FIG. 2).

As an example, a player who has won at least 50 credits in his gaming session may be presented with a button to purchase a 3× Turbo boost lasting for 10 seconds with an associated cost of 50 credits. By pressing the associated Turbo button, the player elects to invest 50 previously earned credits for the opportunity to apply a 3× multiplier of his base wager to any winning results occurring within the next 10 seconds of play. The base wager, according to embodiments of the present invention, is measured according to the time gaming method described herein in which the wager is a function of the time elapsed between the last triggering interaction and the immediately preceding triggering interaction.

Such a scenario would cause the game to enter a Turbo Bet Sequence in which the player's credit meter would be debited by the cost of the turbo boost as shown at 302 (in this case 50 credits), the player's bet multiplier for future wagers would temporarily increase as shown at 304 (in this case by a multiple of ×3), and the timer associated to the Turbo boost would begin at 306 (in this case ticking down from 10 seconds).

As long as the player in this scenario has time remaining on his turbo clock 308, any triggering interactions (i.e. bets) that occur 310 will be subject to the purchased bet multiplier (in this case ×3). Whenever a successful triggering interaction occurs, the game captures the amount of time between a last successful bet to determine the base wager (each unit of time has a monetary value based on the contract price), applies the appropriate multiplier to it (×1 in cases where no Turbo boost has been purchased or a higher multiplier such as ×3 in the case where a Turbo boost has been purchased), and then randomly reference a pay table stored within the game to determine the financial outcome of the interaction as shown at 312. If this random call 314 leads to the player winning funds 316 then winnings are added to the player's session credit meter as shown at 318.

The player may continue to trigger interactions and make wagers under the terms described above until his Turbo Timer expires 320, triggering the end of his Turbo wagering sequence as shown at 322.

Figure 4:
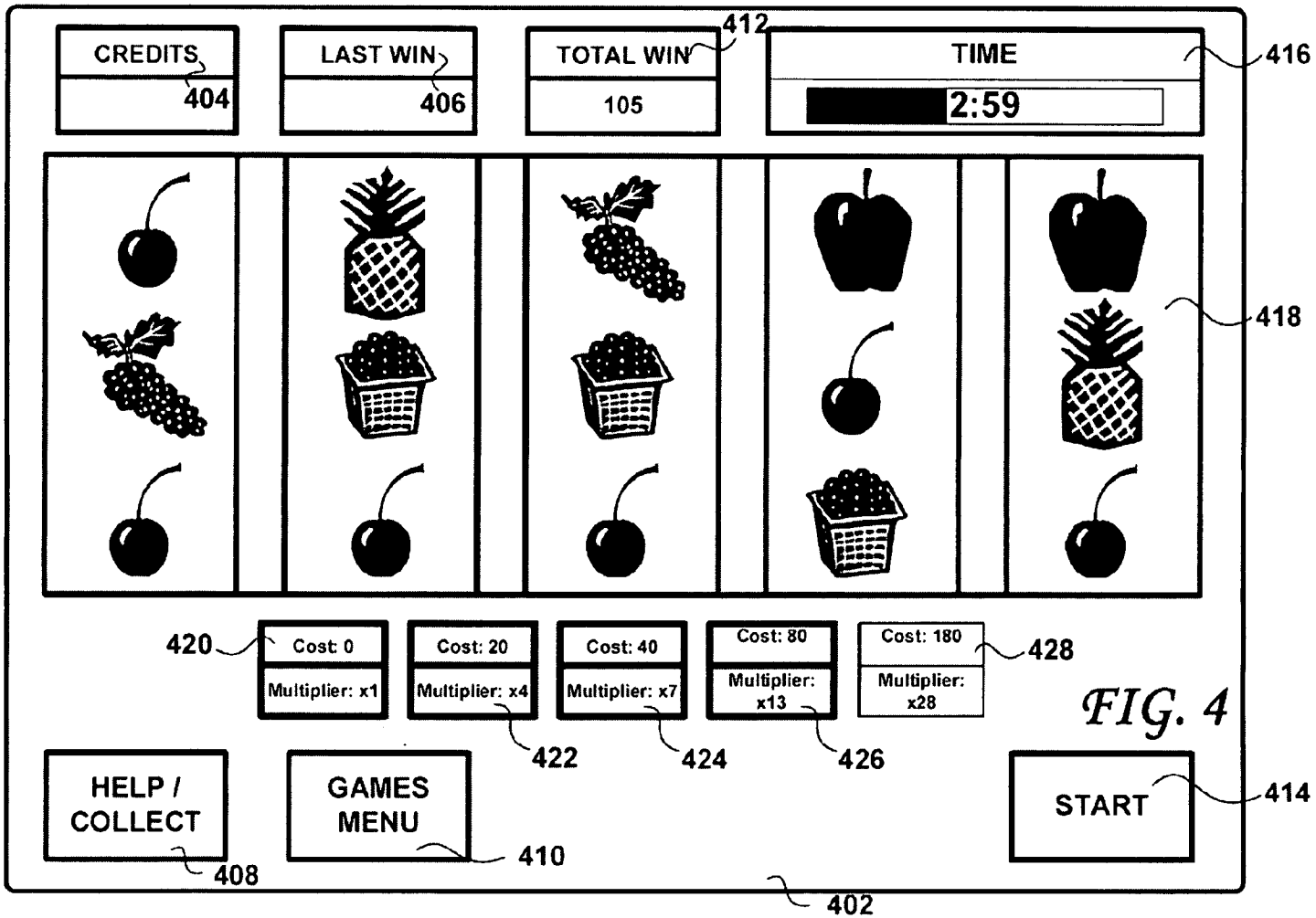
FIG. 4 shows an exemplary user interface that may be used on a Time Slot Machine with Static Reinvestment, according to embodiments of the present invention.

FIG. 4 shows an exemplary user interface for a Time Slot Machine with Static Reinvestment, according to embodiments of the present invention. The depicted gaming screen 402 features traditional betting meters such as CREDITS 404, LAST WIN 406, HELP/COLLECT 408, and MENU 410. Also shown are meters specific to a Time Slot Machine with Reinvestment according to embodiments of the present invention, such as TOTAL WIN 412 (which may read, alternatively, as TIME CONTRACT WIN or session credit meters). The TOTAL WIN meter 412 displays how many credits the player has won during the current gaming contract or time session. In addition, the depicted gaming screen 402 may also include a START button 414 which may be used to start a gaming contract and cause a clock 416 to begin to tick down (or up). As game play unfolds, buttons may serve multiple functions at appropriate time during game play. For example, the START button may be dynamically reconfigured to assume the role of a SPIN button after a contract has stalled.

The reels and symbols on a Time Slot Machine with Reinvestment 418 may be traditional (e.g., fruit symbols or other known symbols) and require no significant modifications from a standard video slot machine. Embodiments of the present invention, however, call for "Extra Bet" buttons to appear on the screen to allow players to activate the reinvestment feature when such features are available (i.e., when the player has sufficient funds available, as shown in the session credit meters). Button 420 represents the base wager in the game, which allows the player to wager 1 credit per payline at a cost of 0 credits (i.e., at no additional cost, as this bet is pall of the base contract that the player has previously purchased). Other "Extra Bet" buttons may be provided, to enable the player to wager any additional funds he or she may have available on the outcome of his next wager. For example, "Extra Bet" button 422 allows the player to wager 4 credits per payline on his next wager at a cost of 20 credits (thus, a win multiplier of ×4 is applied to any base win). Similarly, Extra Bet" button 424 allows the player to wager 7 credits per payline on his next wager at a cost of 40 credits (thus, a win multiplier of ×7 is applied to any base win). Likewise, an "Extra Bet" button 426 may be provided, allowing the player to wager 13 credits per payline on his next wager at a cost of 80 credits (thus, a win multiplier of ×13 is applied to any base win). None, one, some or all of these "Extra Bet" buttons may be available to the player, depending upon his or her outstanding credit balance, as indicated by the session credit meters. In the exemplary situation shown in FIG. 4, because the player has a total win balance of 105 credits, as shown at 412, and because all of the extra bets associated with "Extra Bet" buttons 420 422 424 and 426 cost less than 105 credits, all of the "Extra Bets" buttons 422, 424 and 426 are made available to the player and are this illuminated (or otherwise activated), indicating their availability to the player. The last "Extra Bet" button 428 is not illuminated and is not available to the player, as the cost thereof exceeds the amount available in the TOTAL WIN 412. Therefore, the player does not, in this example, have the opportunity to apply the ×28 multiplier to any base win the player may achieve on his next wager.

Although the exemplary user interface 402 assumes a static number of paylines and a variable bet per payline, other models are possible. For example, a Time Slot Machine with Reinvestment, according to another embodiment of the present invention could grant, for example, the player a base bet of 5 credits per 1 payline and then, as that player accumulated credits within his session, make available bets of 5 credits per 4 paylines, 5 credits per 7 paylines, etc. Indeed, a significant aspect of Time Gaming with Reinvestment, according to embodiments of the present invention, is that the cost of the purchased contract includes the ability to make built-in base wagers, but does not preclude the player from upgrading the overall size of his or her wagers (or increasing the potential payoff thereof) once the player has earned sufficient credits during the contract or the potential win, as indicated by the session credit meters.

Figure 5:
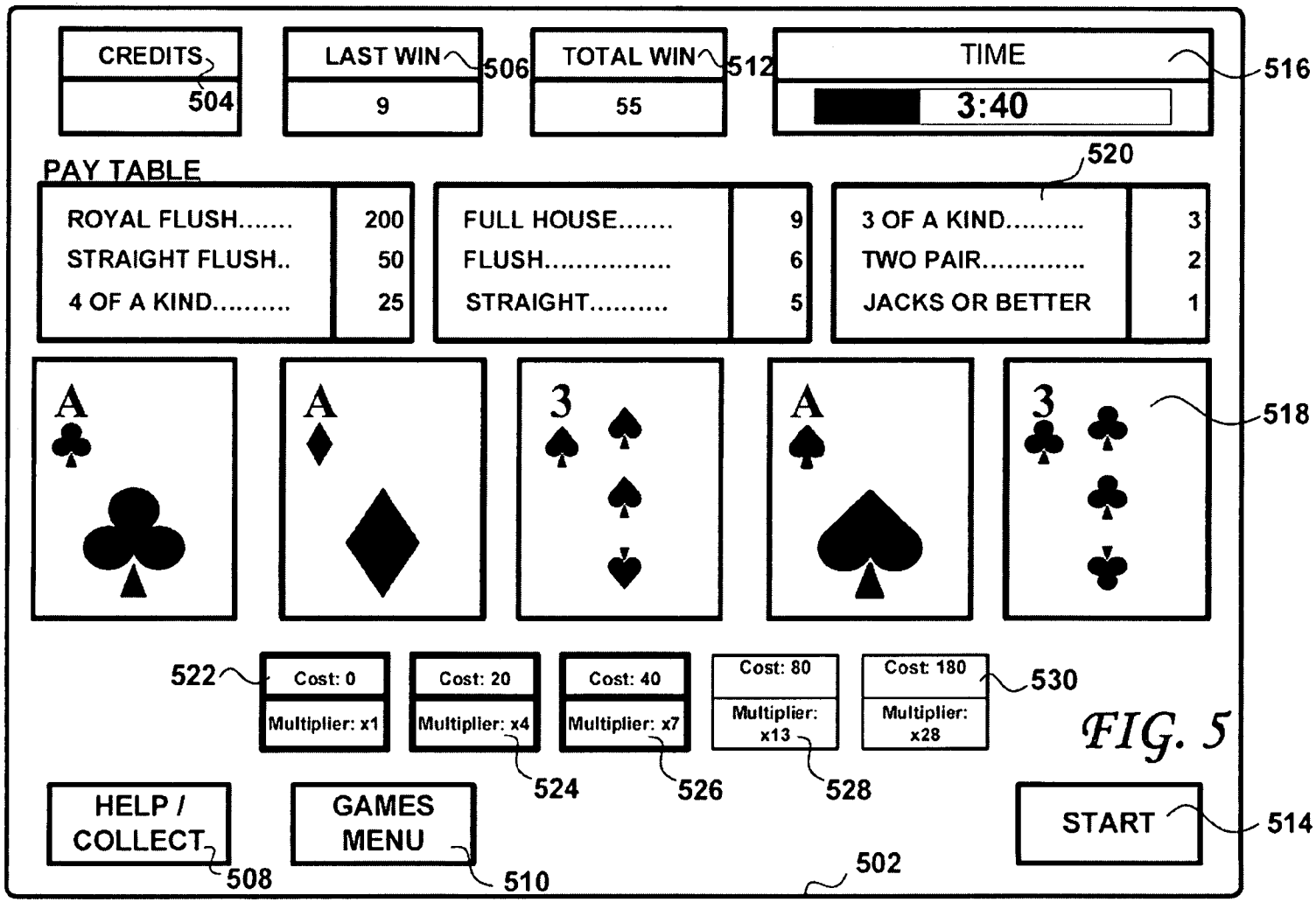
FIG. 5 shows an exemplary user interface that may be used in conjunction with a Time Poker Game with Static Reinvestment, according to embodiments of the present invention.

FIG. 5 shows an exemplary user interface for a Time Poker Game with Static Reinvestment, according to another embodiment of the present invention. The user interface 502 may include betting meters such as, for example, CREDITS 504, LAST WIN 506, HELP/COLLECT 508, and MENU 510. The user interface 502 may also include, according to embodiments of the present invention, meters specific to a Time Poker Game with Reinvestment such as, for example, TOTAL WIN 512 (which may read, alternatively, as CONTRACT WIN or session credits). The meter 512 displays how many credits the player has won during the current gaming contract. In addition, the user interface 502 may include a START button 514, which may be used to stair a gaming contract and cause the clock or timer 516 to begin to tick down (or up). As game play unfolds, buttons may be dynamically reconfigured to serve multiple functions, according to the current context of the game. For example, the START button may be reconfigured, during game play, to assume the role of a DEAL/DRAW button after a session has started. In all embodiments of the present invention, the term "button" may refer to a mechanical button, an area on a touch-sensitive display or any means of providing player interactivity, as embodiments of the present invention are not limited to any one user interaction technology or mode of interaction.

The cards 518 and paytable 520 of a Time Poker Game with Reinvestment may be conventional and need not require significant modifications. However, "Extra Bet" buttons, according to embodiments of the present invention, are provided to allow players to activate the reinvestment features of embodiments of the present inventions. Button 522 represents the base wager in the game, and provides the player with a base bet multiplier of 1, meaning that every time the player achieves a reward generating hand, the value of that hand on the pay table is multiplied by 1 and awarded to the player. "Extra Bet" buttons may be provided to the player, enabling him to enhance any win he may achieve on his next wager. For example, all "Extra Bet" button 524 may be provided, which allows the player to purchase a bet multiplier of ×4 at a cost of, for example, 20 credits, applicable to the player's next wager. Likewise, "Extra Bet" button 526 allows the player to purchase a bet multiplier of ×7 for his next wager at a cost of, for example, 40 credits. Because the player in this example has a current session credit balance of 55 credits as shown at 512, each of the "Extra Bet" buttons 524, 526 are available to the player and are, therefore, illuminated, highlighted or otherwise made active, to alert the player that they may be selected to enhance any win they may achieve. "Extra Bet" button 528, which allows the player to purchase a bet multiplier of ×13 for his next wager at a cost of 80 credits is not available to the player currently, but would become available if the player were to win an additional 25 credits. Similarly, "Extra Bet" button 530, which allows a player to purchase a bet multiplier of ×28 at a cost of 180 credits is also not available, because the session credit meters 512 do not show sufficient credits that would enable the "Extra Bet" button 530 to become active. Indeed, the player would need to win an additional 125 credits to become eligible to activate this feature.

FIG. 6 shows another exemplary user interface for a console type game adapted to Time Gaming with Dynamic Reinvestment according to embodiments of the present invention. The user interface 602 may include traditional betting meters such as CREDITS 604, LAST WIN 606, HELP/COLLECT 608, and MENU 610. The user interface 602 may also include meters specific to a console type game adapted to Time Gaming with Reinvestment, such as TOTAL WIN 612 (which may read, alternatively, as CONTRACT WIN or session credits). This meter may display the number of credits won by the player in the course of the current gaming contract. A START button 614 may also be provided, which may be used to start a gaming contract and cause the clock or timer 616 to begin to tick down (or tip).

The user interface 602 of this console type game adapted to Time Gaming with Dynamic Reinvestment features an outer space themed video game. Time-based casino video games are described in detail in Cyberview Technology's pending patent application entitled "Return Driven Outcome Generator," U.S. Ser. No. 60/969,137 and pending patent application entitled "Method and System for Time Gaming with Skill Waging Opportunities," U.S. Ser. No. 11/457,137, both of which are hereby incorporated herein by reference in their entirety. Such games convert scoring events occurring during console style video game play into opportunities for the player to win credits. For example, a player playing a casino version of the popular video game Space Invaders® might be given the opportunity to win credits every time the player achieves a triggering interaction which, in the Space Invaders® game, may include every time (or selected times) that the player's cannon 618 destroys an alien 620.

According to embodiments of the present invention, the math behind Time Based Casino Video Games may be computed as follows. The cost of the player's gaming contract may be divided by the duration of that gaming contract, such that every second or millisecond (or other selected time slice) of the contract has a predetermined cash value. Whenever each, selected or some key collisions (i.e., triggering interactions) occur within the game, a "measured wager" occurs behind the scenes, meaning that both a random number generator and an internal paytable are referenced. The size of the measured wager may be determined, for example, by the interval between collisions (or triggering interactions). For example, if a player has purchased a 60 second contract to play Space Invaders® (configured according to embodiments of the present invention) for 60 cents, and his first triggering interaction occurs 5 seconds into the game, the first wager of the time contract is 5 cents. If the second triggering interaction occurs 15 seconds into the game, his second wager of the time contract is 10 cents because the value of the timer at the second interaction (15 seconds) is subtracted from the value of the timer at the time of the first triggering interaction (5 seconds), resulting in a difference of 10 seconds. As each second of game play is valued at 1 cent in this example, the value of the wager placed at the time of the second triggering interaction is 10 cents. If the player's third wager occurs at 40 seconds into the game, his third wager would be 25 cents, as the third triggering interaction occurred 25 seconds after the second triggering interaction.

Reinvestment in Casino Video Games, according to further embodiments of the present invention, may take the form of a time based "turbo" boost in wager size. According to these dynamic embodiments, players may purchase the right to increase the value of each unit of time for a set period of turbo boost time, such that whenever collisions (triggering interactions) occur during the set period of turbo boost time, both the size of the wager and the potential win will be larger. According to embodiments of the present invention, games may offer this turbo boost feature to the player dynamically whenever he or she has achieved sufficient winnings. For example and with reference to FIG. 6, a player may activate a time based turbo boost by pressing or otherwise actuating a "Turbo Boost" button on the gaming cabinet or screen such as shown at 622, 624 and 626. Such "Turbo Boost" buttons, according to embodiments of the present invention, may be selectively enabled when the player has earned sufficient credits during his contract to purchase them. In the exemplary case shown in FIG. 6, the player has a balance of 50 credits, as shown at reference numeral 612. This balance qualifies the player to purchase the turbo boost labeled "TURBO1" shown at 622, which costs 20 credits and awards a 10 second turbo boost or the turbo boost labeled "TURBO2" shown at 624, which costs 40 credits and also awards a 10 second boost (at a boost multiplier that his higher than "TURBO1"). The "Turbo Boost" buttons 622, 624 are enabled because they are available, as the player has sufficient credits to purchase the indicated turbo boost time. The "Turbo Boost" button associated labeled TURBO3, shown at 626, is not enabled because the player does not have the 80 credits required to activate it. According to embodiments of the present invention, the more expensive a turbo boost is, the larger the reward multiplier for any wins that occur during the purchased turbo boost time period. The reward multipliers may be hidden from the player as they are in FIG. 6 or they may be shown to the player, as they are in the slot machine and video poker examples detailed in FIG. 4 and FIG. 5.

Activating a turbo boost, according to embodiments of the present invention, debits the player's session credit meter by the cost of the turbo boost, but increases the size of the player's potential rewards for wins during the period of time during which the turbo boost is active. It should be noted that, while three turbo boosts are shown in FIG. 6, games offering the player a greater or a lesser number of turbo boosts are possible. In should also be noted that, while all three boosts in FIG. 6 last for the same duration (10 seconds in this case), turbo boost menus may be structured differently. For example, a menu of five turbo boosts may be offered where the reward multiplier for each boost remains constant, but the time associated with each boost increases as the boosts become more expensive. Other permutations of cost, duration and multipliers are possible, and all such permutations are to be considered to fall within the scope of the embodiments described, shown and claimed herein.

It should also be noted that the betting model associated with Time Based Casino Game with Dynamic Reinvestment that is illustrated in FIG. 6 is a departure from the underlying math of the Time Based Slot Machine with Static Reinvestment described in FIG. 4 and the Time Based Poker Game with Static Reinvestment described in FIG. 5. Indeed, in the Time Based poker and slot games with Static Reinvestment, the base bet is fixed rather than variable. Instead of calculating the interval between bets in real time, as is done in Time Based Casino Games with Dynamic Reinvestment, the slot and poker games, according to further embodiments of the present invention, determine the fastest rate of play possible and use the determined fastest rate to determine an interval between bets and therefore assign a fixed bet value. For example, in a video slot game where the fastest the player may spin the reels is every 3 seconds, the base bet value might be assigned as follows: if the player purchased a 60 second contract for 60 cents, the base for all bets would be 3 cents (since the fastest each bet could occur is once every 3 seconds and since each second has a cash value of 1 cent). This base would hold constant whether the player achieved 20 spins during his session (optimal play) or 10 (sub-optimal play). Further illustration of the Static Reinvestment model is provided in FIGS. 8*a* and 8*b*.

Figure 7:
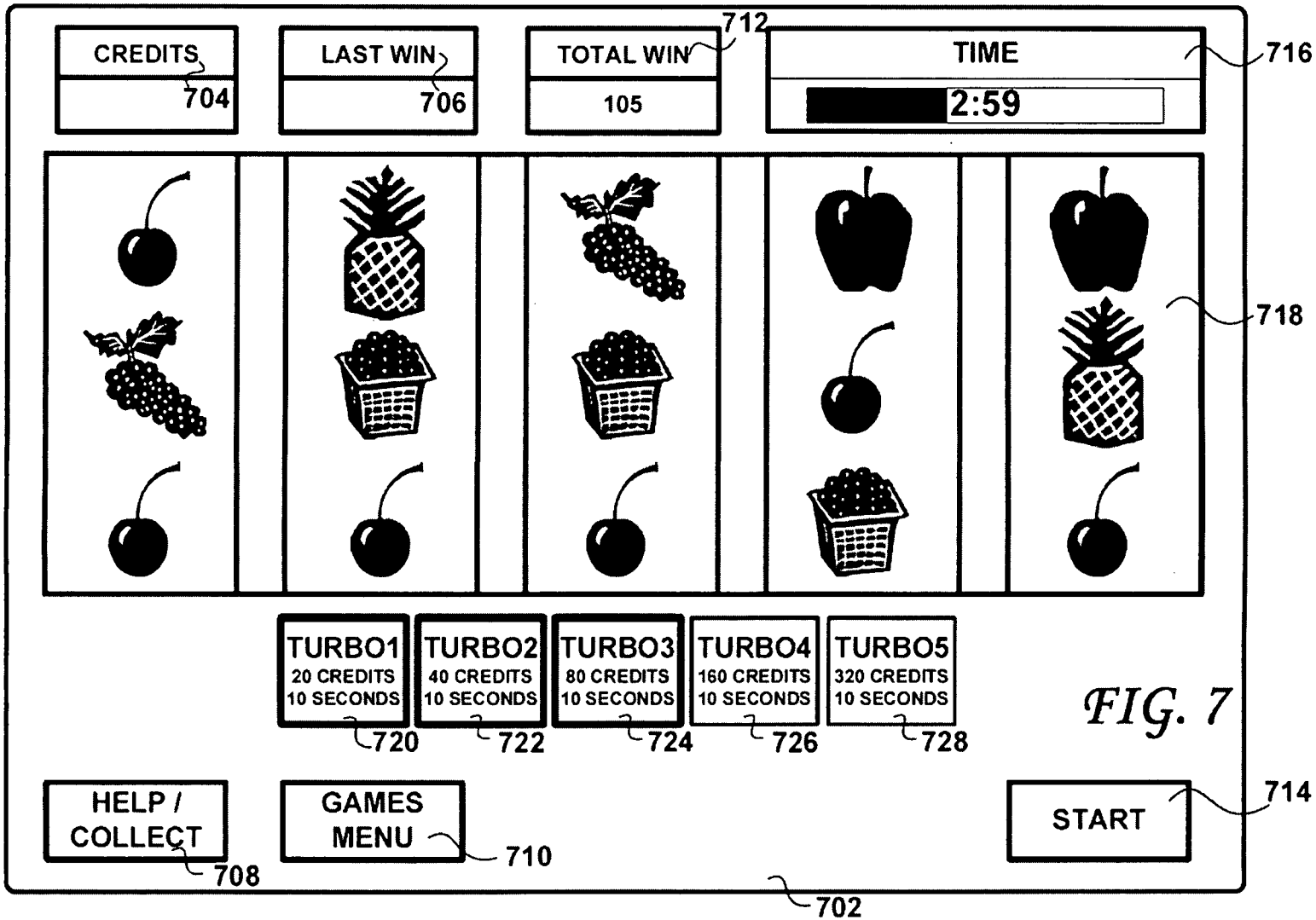
FIG. 7 shows an exemplary user interface that may be used on a Slot Machine with Dynamic Reinvestment, according to embodiments of the present invention.

FIG. 7 shows an exemplary user interface that may be used on a Slot Machine with Dynamic Reinvestment, according to embodiments of the present invention. While the preceding has taught scenarios in which it is possible for the player to purchase static extra bets in traditional electronic casino games like video slots and video poker and scenarios in which it is possible for the player to purchase "turbo boosts" in next generation console style casino games, these descriptions are not intended to be taken in a limiting sense. For example, time-based traditional games like video slots or video poker may allow players to purchase the right to wager at higher stakes for a timed subset of their gaming contract. The video slot machine interface depicted at 702 features such a scenario.

The depicted gaming screen 702 features traditional betting meters such as CREDITS 704, LAST WIN 706, HELP/

COLLECT 708, and MENU 710. Also shown are meters specific to a Time Slot Machine with Reinvestment according to embodiments of the present invention, such as TOTAL WIN 712 (which may read, alternatively, as TIME CONTRACT WIN or session credit meters). The TOTAL WIN meter 712 displays how many credits the player has won during the current gaming contract or time session. In addition, the depicted gaming screen 702 may also include a START button 714 which may be used to start a gaming contract and cause a clock 716 to begin to tick down (or up). As game play unfolds, buttons may serve multiple functions at appropriate time during game play. For example, the START button may be dynamically reconfigured to assume the role of a SPIN button after a contract has started.

The reels and symbols on a Time Slot Machine with Reinvestment 718 may be traditional (e.g., fruit symbols or other known symbols) and require no significant modifications from a standard video slot machine. Embodiments of the present invention, however, call for "Turbo" buttons to appear on the screen to allow players to activate the reinvestment feature when such features are available (i.e., when the player has sufficient funds available, as shown in the session credit meters).

According to embodiments of the present invention, games may offer this turbo boost feature to the player dynamically whenever lie or she has achieved sufficient winnings. For example and with reference to FIG. 7, a player may activate a time based turbo boost by pressing or otherwise actuating a "Turbo Boost" button on the gaming cabinet or screen such as shown at 720, 722, 724, 726, and 728. Such "Turbo Boost" buttons, according to embodiments of the present invention, may be selectively enabled when the player has earned sufficient credits during his contract to purchase them. In the exemplary case shown in FIG. 7, the player has a balance of 105 credits, as shown at reference numeral 712. This balance qualifies the player to purchase the turbo boosts labeled "TURBO1" shown at 720, which costs 20 credits and awards a 10 second turbo boost or the turbo boost labeled "TURBO2" shown at 722, which costs 40 credits and also awards a 10 second boost (at a boost multiplier that his higher than "TURBO1") or the turbo boost labeled "TURBO3" shown at 724, which costs 80 credits and also awards a 10 second boost (at a boost multiplier that is higher than both "TURBO1" and "TURBO2"). The "Turbo Boost" buttons 720, 722, and 724 are enabled because they are available to the player, as the player has sufficient credits to purchase the indicated turbo boost time. The "Turbo Boost" buttons associated labeled TURBO4 and TURBO5, shown at 726 and 728, are not enabled because the player does not have the 160 credits required to activate TURBO4 or the 320 credits required to activate TURBO5. According to embodiments of the present invention, the more expensive a turbo boost is, the larger the reward multiplier for any wins that occur during the purchased-turbo boost time period. The reward multipliers may be hidden from the player as they are in FIG. 7 or they may be shown to the player, as they are in the fixed bet reinvestment models detailed in FIG. 4 and FIG. 5.

Figure 8A:
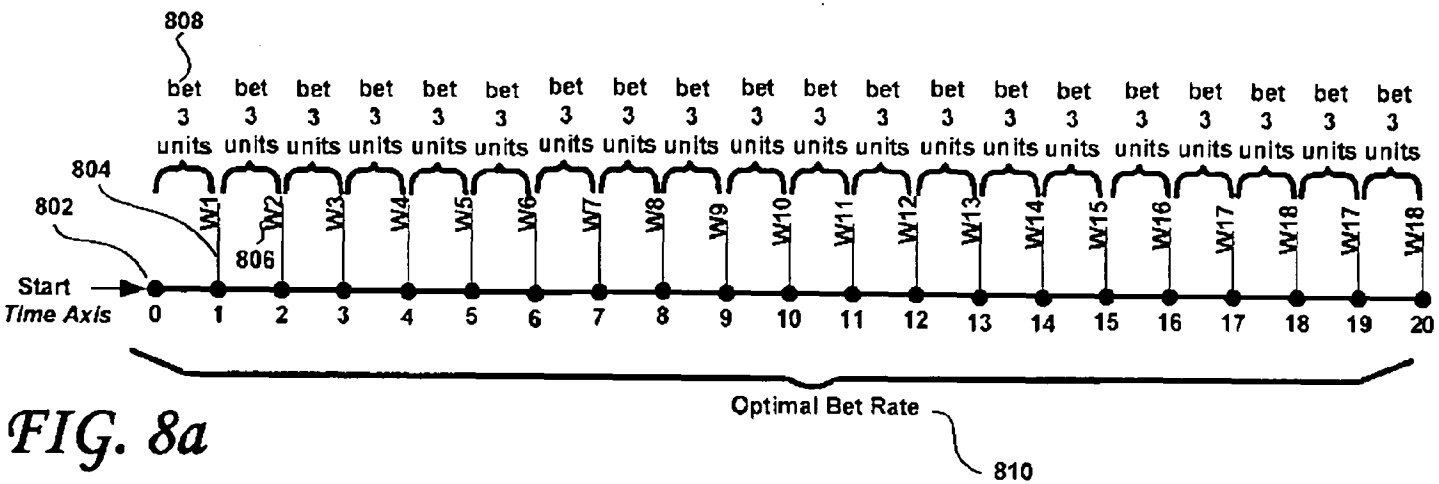
FIG. 8*a* shows how optimal bet sizing may be calculated within a Time Game with Static Reinvestment, according to embodiments of the present invention.

FIG. 8*a* further shows how optimal bet sizing may be calculated, within the context of a game configured according to Time Gaming with Static Reinvestment according to embodiments of the present invention. In FIG. 8*a*, the duration of the gaming contract is expressed as a horizontal time axis 802. If a game is configured such that the player may not wager any faster than once every 3 seconds and the total duration of that player's contract is 60 seconds, then the player may make a maximum of 20 wagers over the course of his contract, with those wagers 804 shown as "W1" through "W20." The duration between the first wager 804 and the second wager 806 in this scenario is 3 units of time 808, or 3 seconds. Note that the duration between any two wagers in this optimal play scenario is 3 units of time, as the optimal betting rate 810 in this game is once every 3 seconds. Because a second in this contract has a cash value of 1 cent, a player betting at the optimal betting rate would wager 3 cents per bet. The optimal bet size is significant in embodiments of the present invention, as it allows the game to estimate the player's rate of play based on optimal play and then use those estimates to offer the player novel betting features such as time-based reinvestment opportunities.

Figure 8B:
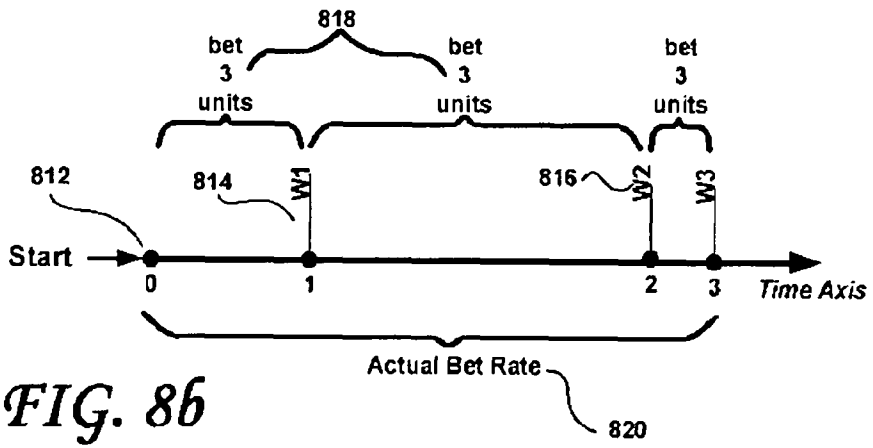
FIG. 8*b* shows how bet sizing may be handled in an actual Time Gaming with Static Reinvestment scenario, according to embodiments of the present invention.

FIG. 8*b* depicts how bet sizing may be handled in an exemplary Time Gaming with Static Reinvestment scenario. The duration of the gaming session (the purchased contract) is expressed by a horizontal time axis 812. FIG. 8*b*, however, represents an example of actual play instead of theoretical play, so the player wagers at any speed he or she wishes. Even when the player bets at irregular intervals as shown in FIG. 8*b*, as evidenced by the large amount of time elapsed between the first wager "W1" 814 and the second wager "W2" 816, the player's bet size remains at a constant 3 units as suggested at 818. The player's actual bet rate 820 may be at any pace he or she desires, but the bet value will remain: a) constant and b) as if he or she were playing at the optimal rate.

Players who play slowly, or sub-optimally, in this model will receive lower returns, on average, than players who play at the optimal rate, as their slower than optimal rate of play affords them with fewer opportunities to win. To ensure that all games return a consistent and reliable percentage of funds wagered back to players (a requirement mandated by the gaming control boards in many jurisdictions), a feature may be added to such games to convert time in which the player could be wagering but chooses not to (i.e., player inefficiency) into currency and then add that currency to a pool to be awarded to players either randomly or based on skill. FIG. 5 of Cyberview Technology's pending patent application entitled "Multi-Player Regulated Gaming with Consolidated Accounting" U.S. Ser. No. 11/456,528, which is hereby incorporated herein by reference in its entirety, demonstrates one example of how such a feature may be employed to ensure predictable accounting on such machines.

Figure 9:
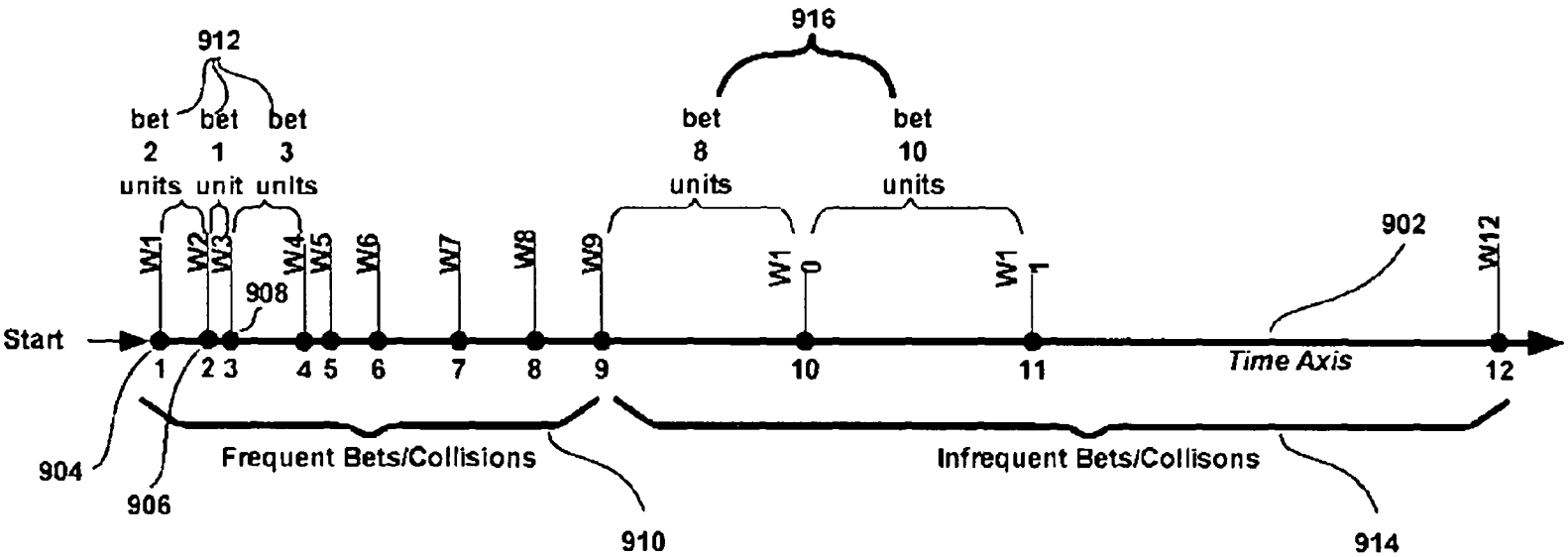
FIG. 9 shows how dynamic bet sizing works within a Casino Video Game with Dynamic Reinvestment, according to embodiments of the present invention.

FIG. 9 shows how dynamic bet sizing may be configured within a Casino Game with Dynamic Reinvestment, according to embodiments of the present invention. Unlike Games with Static Reinvestment, Casino Games with Dynamic Reinvestment do not need to assume optimal play and then use that assumption to determine a base wager. Instead, Games with Dynamic Reinvestment according to embodiments of the present invention may determine wager sizes dynamically by: a) dividing the duration of the player's contract by its cost to the player to determine the value of time, b) determining, in real time, the interval between triggering interactions or collisions as they occur to assign value to each wager (the wager is a function of the measured time interval, thus is named "measured wager"), and c) applying an additional multiplier or bet to the measured wager when eligible players purchase the right to do so.

Again, the duration of the player's contract is represented by the horizontal time axis 902. As the player engages in a Casino Game with Dynamic Reinvestment, collisions occur (triggering interactions). Each selected collision (or triggering interaction) initiates a "measured wager" within the game, where the player has the opportunity to win funds (credits). These "measured wagers" are non-traditional in the sense that the player does not press a "bet" button to initiate them, but share the spirit of traditional betting in the sense that they represent opportunities for the player to win funds, but the action or actions that initiate a wager being placed are carried out upon a triggering interaction being detected, such as a pinball ball hitting a selected bumper or a starship rocket exploding an enemy ship. According to embodiments of Casino Video Games with Reinvestment, wagers resulting from such triggering interactions may only result in credit neutral or credit positive financial outcomes, meaning that the player's current balance cannot be lowered based on the outcome of a wager placed upon the occurrence of a triggering interaction.

As shown in FIG. 9, wagers that are placed upon the occurrence of triggering interactions are represented by dots 904 on the time axis 902. In this case, the first wager 904 is shown at W1, the second wager 906 is shown at W2 and the third wager 908 is shown at W3. The pace in which die player causes triggering interactions within the game affects his or her gaming experience. When the player causes frequent triggering interactions as shown at 910, the player's wager sizes will be smaller as is shown by the smaller wagers 912 referenced at W2, W3 and W4. When the player causes more infrequent triggering interactions as shown at 914, the sizes of the wagers, as shown at 916 will be comparatively larger, as shown at W10 and W11. This dynamic—outlined in Cyberview Technology's "Cashless Time Gaming" patent, U.S. Pat. No. 6,645,075, also incorporated herein in its entirety, ensures that the game's return to player (RTP) remains fixed regardless of the pace at which he or she plays the game.

It should be noted that instances will arise in games featuring Dynamic Reinvestment in which a player initiates a wager, a new collision interval begins, and then after a period of time elapses, the player elects to purchase a Turbo Boost. In this scenario, were the game to weigh the entire collision interval at the purchased Turbo Boost multiplier when the next wager is calculated, the game would become susceptible to advantage play (i.e. the player would be able to play the game at a financial advantage by pausing a long time, purchasing a Turbo Boost and then initiating a wager). There are several methods that may be employed to prevent the player from achieving an advantage over the game in such cases. One solution is to calculate the result of the player's wager by weighing the time elapsed before the Boost was purchased at the base multiplier (i.e. ×1) and the time elapsed after the Boost was purchased at the higher purchased multiplier and adding both figures together to get the result of the player's wager. Another solution is to have the player complete an autobet at the time the Boost is purchased. Yet a third solution involves featuring dynamic Boost buttons on the gaming machine that take into account the current collision interval when determining the size of purchasing a boost.

Figure 10:
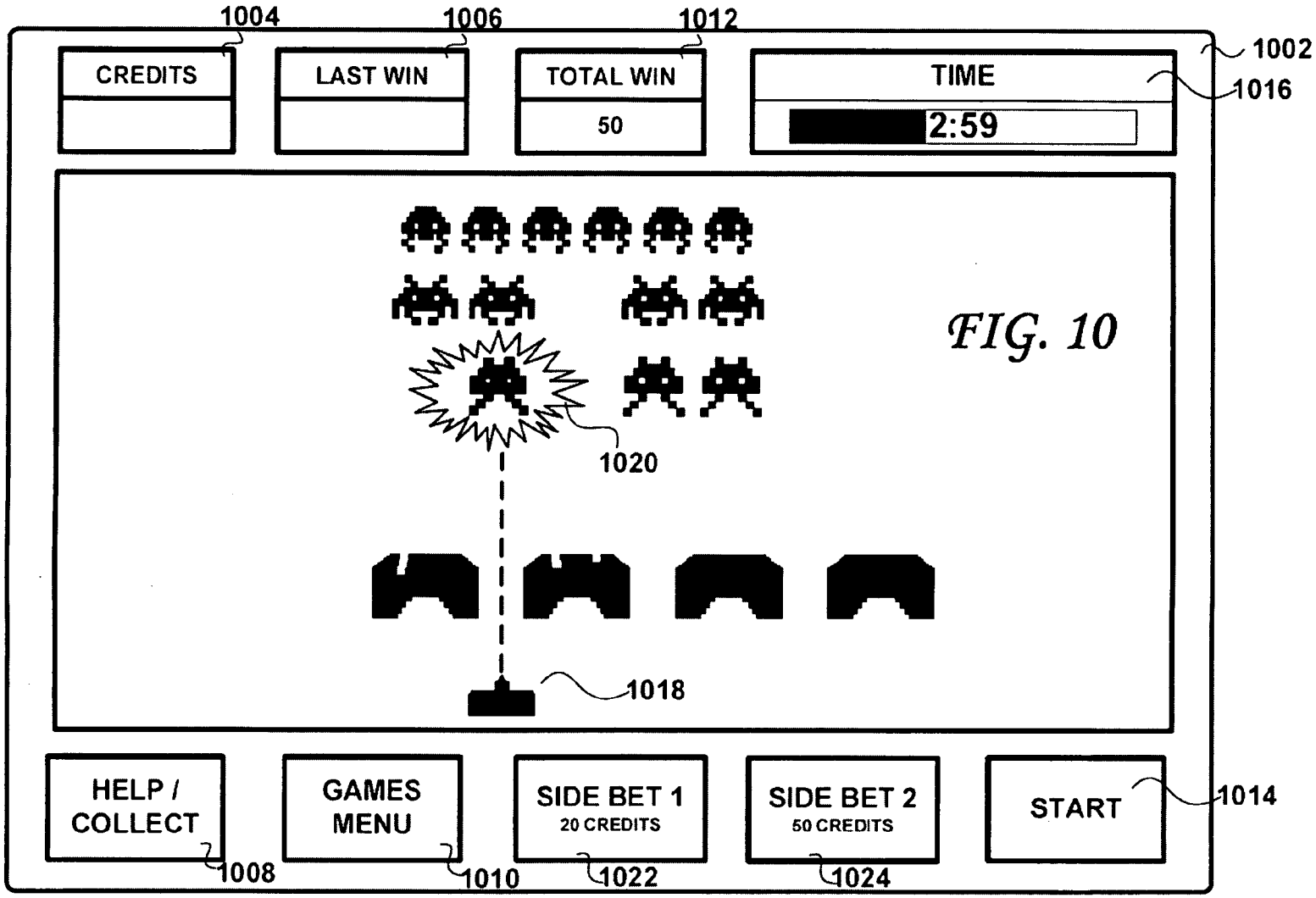
FIG. 10 shows an exemplary user interface that may be used on a Next Generation Casino Game with Side Bet Reinvestment, according to embodiments of the present invention.

FIG. 10 shows an exemplary user interface that may be used on a Next Generation Casino Game with Side Bet Reinvestment, according to embodiments of the present invention. Side Bet Reinvestment is a form of Static Reinvestment applicable to next generation casino action games such as the Space Invaders® themed game depicted at 1002. In such a model, the user interface 1002 may include traditional betting meters such as CREDITS 1004, LAST WIN 1006, HELP/COLLECT 1008, and MENU 1010. The user interface 1002 may also include meters specific to a console type game adapted to Time Gaming with Reinvestment, such as TOTAL WIN 1012 (which may read, alternatively, as CONTRACT WIN or session credits). This meter may display the number of credits won by the player in the course of the current gaming contract. A START button 1014 may also be provided, which may be used to stair a gaming contract and cause the clock or timer 1016 to begin to tick down (or up).

The user interface 1002 of this console type game adapted to Time Gaming with Dynamic Reinvestment features an outer space themed video game equipped for Time Gaming as described herein. In such a model, the player is given the opportunity to win credits every time he achieves a triggering interaction which, in the Space Invaders® game, may include every time (or selected times) that the player's cannon 1018 destroys an alien 1020.

According to embodiments of the present invention, the math behind Time Based Casino Video Games may be computed as follows. The cost of the player's gaming contract may be divided by the duration of that gaming contract, such that every second or millisecond (or other selected time slice) of the contract has a predetermined cash value. Whenever each, selected or some key collisions (i.e., triggering interactions) occur within the game, a "measured wager" occurs behind the scenes, meaning that both a random number generator and an internal paytable are referenced. The size of the measured wager may be determined, for example, by the interval between collisions (or triggering interactions).

Reinvestment in Casino Video Games, according to further embodiments of the present invention, may take the form of a reinvestment side bet. According to such embodiments, players may apply some of their previous winnings within the contract to their next wager. For example and with reference to FIG. 10, a player may activate the side bet reinvestment feature by pressing or otherwise actuating a "Side Bet" button on the gaming cabinet or screen such as shown at 1022 and 1024. Such "Side Bet" buttons, according to embodiments of the present invention, may be selectively enabled when the player has earned sufficient credits during his contract to purchase them. In the exemplary case shown in FIG. 10, the player has a balance of 50 credits, as shown at reference numeral 1012. This balance qualifies the player to purchase the Side Bet labeled "Side Bet 1" shown at 1022, which costs 20 credits or the side bet labeled "Side Bet 2" shown at 1024, which costs 40 credits. These side bet buttons 1022, 1024 are enabled because they are available, as the player has sufficient credits to purchase the indicated bets.

The size of a wager occurring after the player has activated the side bet reinvestment feature may be calculated by adding the size of the side bet to the dynamically calculated base wager (which, as has been described herein, is a function of the time interval between wagers and the value of a unit of time). For example, if a player has purchased a 60 second contract to play Space Invaders® (configured according to side bet reinvestment embodiment of the present invention) for 60 cents, and if the credit value on such a game was 1 cent per credit, and the time interval between the player's wager n and his wager n+1 is 5 seconds, then the size of wager n+1 would be 5 cents. If, however, the player had elected to purchase a side bet of 20 credits after making wager n but before making wager n+1, then the size of wager n+1 would be 25 credits (the 5 credit base wager+the 20 credit side bet).

Activating the side bet reinvestment feature, according to embodiments of the present invention, debits the player's session credit meter by the cost of the side bet, but increases the size of the player's potential rewards for his next wager. It should be noted that, while two side bets are shown in FIG. 10, games offering the player a greater or a lesser number of side bets are possible. In should also be noted that onscreen side bet buttons may take on an enable/disable appearance scheme to feature a number of side bet buttons but only enable those side bet options that the player is currently eligible for or they make take on a dynamic appearance scheme, dynamically changing the cost of the side bet buttons based on the player's current credit status. Other permutations appearance schemes are also possible, and all such permutations are to be considered to fall within the scope of the embodiments described, shown and claimed herein.

While the foregoing detailed description has described several embodiments of this invention, it is to be understood that the above description is illustrative only and not limiting of the disclosed invention. For example, while Time Based Slot Machines with Reinvestment, Time Based Poker Games with Reinvestment, and a Casino Space Invaders® Game with Reinvestment were described, the Time Based Reinvestment model could just as easily be applied to any popular casino game including blackjack, video roulette, video craps, and video bingo or to many popular arcade games including pinball, maze games like Pac-Man®, and video games like Super Mario Bros®, Halo®, or Grand Theft Auto®. Indeed, a number of modifications will no doubt occur to persons of skill in this art. All such modifications, however, should be deemed to fall within the scope of the present invention.

What is claimed is:

1. A method of providing a game session on a gaming machine, comprising:

activating the game session on the gaming machine with a credit of playing time provided by a player of the gaming machine, the game session lasting an amount of time determined by the provided credit of playing time;

maintaining session credit meters during the game session;

placing a wager during the game session;

enabling the player to place an extra bet to selectively increase a potential outcome of the wager when the session credit meters indicate an amount of credits that is larger than a predetermined amount and disabling the player's ability to selectively increase the potential outcome otherwise, and generating a random outcome for the wager and updating the session credit meters according to the wager placed, any extra bet placed, a selected paytable and the generated random outcome.

2. The method of claim 1, wherein the increased potential outcome enabling step is carried out by increasing an amount of the wager by an amount no greater than a current amount indicated by the session credit meters.

3. The method of claim 1, wherein the increased potential outcome enabling step is carried out by applying a selected outcome multiplier to any base winnings indicated by the generated random outcome.

4. The method of claim 1, wherein the session credit meters maintaining step includes initializing the session credit meters to zero at a beginning of the game session.

5. The method of claim 1, wherein the session credit meters maintaining step includes initializing the session credit meters to a non-zero value at a beginning of the game session.

6. The method of claim 1, wherein the placing step is carried out even when the session credit meters indicate a zero value.

7. The method of claim 1, wherein the gaming machine is a reel-type slot machine and wherein the generating step is carried out with the random outcome being a combination of symbols.

8. The method of claim 1, further including a step of offering a plurality of game session contracts to the player, each of the offered game session contracts costing a different number of credits and lasting a different amount of time.

9. The method of claim 1, wherein the gaming machine is configured as a slot machine.

10. The method of claim 9, wherein the gaming machine is configured as a reel type slot machine.

11. The method of claim 1, wherein the enabling step includes a step of providing or activating a plurality of extra bet buttons, each of the extra bet buttons being configured to enable the player to place an extra bet that is at least as great as the predetermined amount.

12. The method of claim 1, wherein the session credit meters updating step includes increasing the session credit meters.

13. The method of claim 1, wherein the maintaining step includes a step of debiting the session credit meters by an amount of the extra bet when the generated random outcome is a losing outcome.

14. The method of claim 1, further including a step of monitoring the game during the game session to detect when one of a plurality of wager triggering interactions occurs within the game and carrying out the wager placing step upon occurrence of one of the wager triggering interactions.

15. The method of claim 1, further including a step of receiving an instruction from the player and carrying out the wager placing step upon receipt of the player instruction.

16. A gaming machine, comprising:

at least one processor;

at least one data storage device coupled to the at least one processor;

a plurality of processes spawned by the at least one processor, the processes including processing logic for, in combination with the at least one data storage device:

activating a game session on the gaming machine with a credit of playing time provided by a player of the gaming machine, the game session lasting an amount of time determined by the provided credit of playing time;

maintaining session credit meters during the game session;

enabling a wager to be placed during the game session;

enabling the player to place an extra bet to selectively increase a potential outcome of the wager when the session credit meters indicate an amount of credits that is larger than a predetermined amount and disabling the player's ability to selectively increase the potential outcome otherwise, and generating a random outcome for the wager and updating the session credit meters according to the wager placed, any extra bet placed, a selected paytable and the generated random outcome.

17. A method of providing a game session on a gaming machine, comprising:

activating the game session on the gaming machine with a credit of playing time provided by a player of the gaming machine, the game session enabling the player to play a game on the gaming machine for an amount of time determined by the provided credit of playing time;

maintaining session credit meters during the game session;

monitoring the game during the game session to detect when a wager triggering interactions occur within the game;

placing a wager when a wager triggering interaction is detected, an amount of the placed wager being a function of elapsed time;

enabling the player to place an extra bet to selectively increase a potential outcome of the wager when the session credit meters indicate an amount of credits that is larger than a predetermined amount and disabling the player's ability to place the extra bet otherwise, and generating a random outcome for the wager and updating the session credit meters according to the wager placed, any extra bet placed, a selected paytable and the generated random outcome.

18. The method of claim 17, wherein the wager placing step is carried out with the elapsed time being determined as a function of an elapsed time since the game session was activated.

19. The method of claim 17, wherein the wager placing step is carried out with the elapsed time being determined as a function of an elapsed time since a previous wager was placed during the game session.

20. The method of claim 17, wherein the extra bet in the enabling step is configured to increase an amount of the wager by an amount no greater than a current amount indicated by the session credit meters.

21. The method of claim 17, wherein the extra bet in the enabling step is configured to increase the potential outcome of the wager by applying a selected outcome multiplier to any base winnings indicated by the generated random outcome.

22. The method of claim 17, wherein the session credit meters maintaining step includes initializing the session credit meters to zero at a beginning of the game session.

23. The method of claim 17, wherein the session credit meters maintaining step includes initializing the session credit meters to a non-zero value at a beginning of the game session.

24. The method of claim 17, wherein the placing step is carried out even when the session credit meters indicate a zero value.

25. The method of claim 17, wherein the gaming machine is a reel-type slot machine and wherein the generating step is carried out with the random outcome being a combination of symbols.

26. The method of claim 17, wherein the gaming machine is configured as a console-type gaming machine.

27. The method of claim 17, further including a step of offering a plurality of game session contracts to the player, each of the offered game session contracts costing a different number of credits and lasting a different amount of time.

28. The method of claim 17, wherein the gaming machine is configured as a slot machine.

29. The method of claim 28, wherein the gaming machine is configured as a reel type slot machine.

30. The method of claim 17, wherein the enabling step includes a step of providing or activating a plurality of extra bet buttons, each of the extra bet buttons being configured to enable the player to place an extra bet that is at least as great as the predetermined amount.

31. The method of claim 17, wherein the monitoring step is carried out with the wager triggering interactions including selected in-game events.

32. The method of claim 17, wherein the monitoring step is carried out with the wager triggering interactions being selected from among a plurality of interactions between the player and the game during the gaming session, and wherein the wager placing step is carried out only when one of the selected interactions occurs during the game session, and wherein occurrence of other ones of the plurality of interactions do not result in the wager being placed.

33. The method of claim 17, wherein the maintaining step includes a step of debiting the session credit meters by an amount of the extra bet when the generated random outcome is a losing outcome.

34. A gaming machine, comprising:

at least one processor;

at least one data storage device coupled to the at least one processor;

a plurality of processes spawned by the at least one processor, the processes including processing logic for, in combination with the at least one data storage device:

activating the game session on the gaming machine with a credit of playing time provided by a player of the gaming machine, the game session enabling the player to play a game on the gaming machine for an amount of time determined by the provided credit of playing time;

maintaining session credit meters during the game session;

monitoring the game during the game session to detect when wager triggering interactions occur within the game;

placing a wager when a wager triggering interaction is detected, an amount of the placed wager being a function of elapsed time;

enabling the player to place an extra bet to selectively increase a potential outcome of the wager when the session credit meters indicate an amount of credits that is larger than a predetermined amount and disabling the player's ability to place the extra bet otherwise, and generating a random outcome for the wager and updating the session credit meters according to the wager placed, any extra bet placed, a selected paytable and the generated random outcome.

35. A method of providing a game session on a gaming machine, comprising:

accepting an amount of money from a player of the gaming machine and setting a length of the game session according to the amount of money accepted from the player;

maintaining session credit meters during the game session;

enabling the player to set a pace at which wagers are placed during the game session and setting an amount of each wager according to the pace set by the player;

selectively providing the player with opportunities to place extra bets to increase potential outcomes of the placed wagers when the session credit meters indicate a sufficient number of credits, and generating random outcomes for the wagers and updating the session credit meters according to the wagers placed, any extra bets placed, at least one selected paytable and the generated random outcomes.

36. The method of claim 35, wherein the session credit meters maintaining step includes initializing the session credit meters to zero at a beginning of the game session.

37. The method of claim 35, wherein the session credit meters maintaining step includes initializing the session credit meters to a non-zero value at a beginning of the game session.

38. The method of claim 35, wherein the enabling and setting steps are carried out even when the session credit meters indicate a zero value.

39. The method of claim 35, wherein the gaming machine is a reel-type slot machine and wherein the generating step is carried out with the random outcome being a combination of symbols.

40. The method of claim 35, wherein the gaming machine is configured as a console-type gaming machine.

41. The method of claim 35, further including a step of offering a plurality of game session contracts to the player, each of the offered game session contracts costing a different number of credits and lasting a different amount of time.

42. The method of claim 35, wherein the gaming machine is configured as a slot machine.

43. The method of claim 42, wherein the gaming machine is configured as a reel type slot machine.

44. The method of claim 35, wherein the session credit meters updating step includes increasing the session credit meters.

45. The method of claim 35, wherein the maintaining step includes a step of debiting the session credit meters by an amount of the extra bet when the generated random outcome is a losing outcome.

46. The method of claim 35, further including a step of receiving an instruction from the player and carrying out the wager placing step upon receipt of the player instruction.

47. A gaming machine, comprising:

at least one processor;

at least one data storage device coupled to the at least one processor;

a plurality of processes spawned by the at least one processor, the processes including processing logic for, in combination with the at least one data storage device:

accepting an amount of money from a player of the gaming machine and setting a length of the game session according to the amount of money accepted from the player;

maintaining session credit meters during the game session;

enabling the player to set a pace at which wagers are placed during the game session and setting an amount of each wager according to the pace set by the player;

selectively providing the player with opportunities to place extra bets to increase potential outcomes of the placed wagers when the session credit meters indicate a sufficient number of credits, and generating random outcomes for the wagers and updating the session credit meters according to the wagers placed, any extra bets placed, at least one selected paytable and the generated random outcomes.

48. A method of providing a game session on a gaming machine, comprising:

activating the game session on the gaming machine with a credit of playing time provided by a player of the gaming machine, the game session lasting an amount of time determined by the provided credit of playing time;

maintaining session credit meters during the game session;

placing a wager during the game session;

determining an amount of the wager placed during the game session as a function of elapsed time;

enabling the player to place an extra bet to selectively increase a potential outcome of the wager when the session credit meters indicate an amount of credits that is larger than a predetermined amount and disabling the player's ability to selectively increase the potential outcome otherwise, and generating a random outcome for the wager and updating the session credit meters according to the wager placed, any extra bet placed, a selected paytable and the generated random outcome.

49. The method of claim 48, wherein the determining step is carried out with the elapsed time being determined as a function of an elapsed time since the game session was activated.

50. The method of claim 48, wherein the determining step is carried out with the elapsed time being determined as a function of an elapsed time since a triggering of a previous wager placed during the game session.

51. The method of claim 48, wherein the increased potential outcome enabling step is carried out by increasing an amount of the wager by an amount no greater than a current amount indicated by the session credit meters.

52. The method of claim 48, wherein the increased potential outcome enabling step is carried out by applying a selected outcome multiplier to any base winnings indicated by the generated random outcome.

53. The method of claim 48, wherein the session credit meters maintaining step includes initializing the session credit meters to zero at a beginning of the game session.

54. The method of claim 48, wherein the session credit meters maintaining step includes initializing the session credit meters to a non-zero value at a beginning of the game session.

55. The method of claim 48, wherein the placing step is carried out even when the session credit meters indicate a zero value.

56. The method of claim 48, wherein the gaming machine is a reel-type slot machine and wherein the generating step is carried out with the random outcome being a combination of symbols.

57. The method of claim 48, wherein the gaming machine is configured as a console-type gaming machine.

58. The method of claim 48, further including a step of offering a plurality of game session contracts to the player, each of the offered game session contracts costing a different number of credits and lasting a different amount of time.

59. The method of claim 48, wherein the gaming machine is configured as a slot machine.

60. The method of claim 59, wherein the gaming machine is configured as a reel type slot machine.

61. The method of claim 48, wherein the enabling step includes a step of providing or activating a plurality of extra bet buttons, each of the extra bet buttons being configured to enable the player to selectively increase a potential outcome of wagers placed on the gaming machine for a predetermined period of time.

62. The method of claim 61, wherein each of the plurality of extra bet buttons is configured, when selected by the player, to cost the player a predetermined amount of credits and to increase the potential outcome of any wagers placed during the predetermined period of time by a predetermined amount and wherein the method further includes a step of dynamically calculating the predetermined amount of credits, period of time and amount based on current game conditions.

63. The method of claim 48, wherein the session credit meters updating step includes increasing the session credit meters.

64. The method of claim 48, wherein the maintaining step includes a step of debiting the session credit meters by an amount of the extra bet when the generated random outcome is a losing outcome.

65. The method of claim 48, further including a step of monitoring the game during the game session to detect when one of a plurality of wager triggering interactions occurs within the game and carrying out the wager placing step upon occurrence of one of the wager triggering interactions.

66. The method of claim 48, further including a step of receiving an instruction from the player and carrying out the wager placing step upon receipt of the player instruction.

67. A gaming machine, comprising:

at least one processor;

at least one data storage device coupled to the at least one processor;

a plurality of processes spawned by the at least one processor, the processes including processing logic for, in combination with the at least one data storage device:

activating the game session on the gaming machine with a credit of playing time provided by a player of the gaming machine, the game session lasting an amount of time determined by the provided credit of playing time;

maintaining session credit meters during the game session;

placing a wager during the game session;

determining an amount of the wager placed during the game session as a function of elapsed time;

enabling the player to place an extra bet to selectively increase a potential outcome of the wager when the session credit meters indicate an amount of credits that is larger than a predetermined amount and disabling the player's ability to selectively increase the potential outcome otherwise, and generating a random outcome for the wager and updating the session credit meters according to the wager placed, any extra bet placed, a selected paytable and the generated random outcome.

* * * * *